US007742724B2

(12) United States Patent
Tazawa et al.

(10) Patent No.: US 7,742,724 B2
(45) Date of Patent: Jun. 22, 2010

(54) DEVELOPER SUPPLY CONTAINER AND IMAGE FORMING APPARATUS

(75) Inventors: Fumio Tazawa, Kashiwa (JP); Nobuo Nakajima, Higashimatsuyama (JP); Kazuyoshi Sasae, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 39 days.

(21) Appl. No.: 10/582,898

(22) PCT Filed: Nov. 11, 2005

(86) PCT No.: PCT/JP2005/021307

§ 371 (c)(1),
(2), (4) Date: Aug. 18, 2009

(87) PCT Pub. No.: WO2006/052028

PCT Pub. Date: May 18, 2006

(65) Prior Publication Data

US 2010/0067957 A1 Mar. 18, 2010

(30) Foreign Application Priority Data

Nov. 12, 2004 (JP) ..... 2004-328678

(51) Int. Cl.
*G03G 15/095* (2006.01)

(52) U.S. Cl. ..... 399/258

(58) Field of Classification Search ..... 399/258, 399/119, 262, 263
See application file for complete search history.

(56) References Cited

U.S. PATENT DOCUMENTS 5,300,991 A 4/1994 Hiraike ..... 355/260
6,009,289 A * 12/1999 Sekine et al. ..... 399/113
6,049,685 A 4/2000 Murakami et al. ..... 399/263
6,169,865 B1 * 1/2001 Miyabe et al. ..... 399/111
6,185,401 B1 2/2001 Kanamori et al. ..... 399/262

(Continued)

FOREIGN PATENT DOCUMENTS

EP 0 736 814 10/1996

(Continued)

OTHER PUBLICATIONS

Chinese Office Action issued Jan. 11, 2008, in Application No. 200580006351.2.

*Primary Examiner*—David P Porta
*Assistant Examiner*—Kiho Kim
(74) *Attorney, Agent, or Firm*—Fitzpatrick, Cella, Harper & Scinto

(57) ABSTRACT

A developer supply container supplies developer to a developer receiving portion of a main assembly of an electrophotographic image forming apparatus. The container includes a developer accommodator, a discharge opening, a stirring member, a first receiver receiving a stirring member driving force from a first transmitter in the main assembly, a member opening and closing the opening, a second receiver receiving a force moving the openable member, and a second transmitter transmitting a force to the second receiver through a main assembly relay. By mounting the container to the main assembly, engagements are established between the first transmitter and the first receiver, between the second transmitter and the relay, and between the relay and the second receiver, so that a force is transmittable from the first transmitter to the first receiver, and a is transmittable from the second transmitter to the second receiver.

14 Claims, 14 Drawing Sheets

U.S. PATENT DOCUMENTS

| | | | | |
|---|---|---|---|---|
| 6,278,853 | B1 | 8/2001 | Ban et al. | 399/109 |
| 6,343,192 | B1 * | 1/2002 | Miyabe et al. | 399/13 |
| 6,345,164 | B1 * | 2/2002 | Yokomori et al. | 399/119 |
| 6,381,430 | B1 * | 4/2002 | Yokomori et al. | 399/119 |
| 6,934,492 | B2 | 8/2005 | Hiura et al. | 399/258 |
| 6,978,107 | B2 | 12/2005 | Nagashima et al. | 399/262 |
| 2003/0161653 | A1 * | 8/2003 | Ban et al. | 399/106 |
| 2005/0135842 | A1 | 6/2005 | Murakami et al. | 399/262 |

FOREIGN PATENT DOCUMENTS

| | | |
|---|---|---|
| EP | 0 895 136 | 2/1999 |
| EP | 0 905 577 | 3/1999 |
| JP | 5-289515 | 11/1993 |
| JP | 6-35321 | 2/1994 |
| JP | 11-194600 | 7/1999 |
| JP | 2000-259061 | 9/2000 |

* cited by examiner

DEVELOPER SUPPLY CONTAINER AND IMAGE FORMING APPARATUS

TECHNICAL FIELD

The present invention relates to a developer supply container for supplying developer to an electrophotographic image forming apparatus (which hereinafter will be referred to simply as image forming apparatus) which forms images with the use of developer, and an image forming apparatus which employs the developer supply container.

BACKGROUND ART

Here, an electrophotographic image forming apparatus means an apparatus which forms an image on recording medium, with the use of an electrophotographic image forming method. As examples of an electrophotographic image forming apparatus, an electrophotographic copying machine, an electrophotographic printer (for example, laser beam printer, LED printer, etc.), a facsimileing machine, a word-processor, etc., can be included.

An image forming apparatus such as an electrophotographic copying machine, a laser beam printer, etc., records an image by selectively exposing numerous points of the uniformly charged photosensitive drum, forming thereby a latent image; developing the latent image with the use of developer, forming an image of the developer; and transferring the image formed of the developer, onto recording medium. This type of image forming apparatus must be supplied with developer each time it runs out of developer. There are roughly two types of a developer supply container for supplying an image forming apparatus with developer: the so-called dumping type, and the cartridge type, that is, the type which is left in the main assembly of an image forming apparatus until it runs out of the developer therein. In the case of the dumping type, the entirety of the developer in the developer supply container is emptied all at once into the buffer portion of the main assembly of the image forming apparatus. In the case of the cartridge type, the developer supply container is mounted into the main assembly of the image forming apparatus to be left therein, and the developer in the developer supply container is gradually released to be supplied to the developing apparatus until the developer supply container becomes depleted of the developer therein.

In recent years, various developer supply containers of the latter type, or the cartridge type, have been proposed from the standpoint of the prevention of the contamination which is liable to occur while supplying an image forming apparatus with developer, and the operability of an image forming apparatus. Some of them are provided with a shutter which is opened or closed to seal or unseal the opening, as the developer outlet, of the container while the container is in the main assembly, and some of them are provided with a stirring member which is disposed in the container to internally convey the developer therein and discharge it while the container is in the main assembly (Patent Document 1).

These proposals make it possible to provide a developer supply container of the cartridge type, which is superior in operability. They also make it possible to prevent the main assembly of an image forming apparatus from being subjected to an excessive amount of load when the main assembly is supplied with developer. Further, they make it possible to simplify a developer supply container itself in structure.

[Patent Document 1: Japanese Patent No. 3408166]

In recent years, however, not only has a compact image forming apparatus main assembly been increasing in demand, but also, the need has been increasing for making compact the developer supplying unit which is for mounting a developer supply container into the main assembly, and also, has the function of supplying the main assembly with the developer in the developer supply container.

However, a developer supply container of the cartridge type, and the developer supplying unit in which a developer supply container of the cartridge type is mounted, are given the function of opening or closing the shutter while the developer supply container is in the main assembly of an image forming apparatus, and the function of moving the stirring member by receiving driving force from the main assembly of an image forming apparatus. Therefore, they are more complicated in mechanical structure, being more difficult to reduce in size, and also, in the space occupied, compared to a developer supply container of the dumping type.

Further, they are limited in terms of the direction from which a developer supply container can be mounted into the main assembly of an image forming apparatus, because of the restrictive relationship between the developer supplying unit and the other units in the internal space of the main assembly, and also, the restriction arising from the limitation in the size of the space necessary to set the main assembly (which includes not only the actual size of the main assembly, but also, the size of the space necessary for opening or closing the cover thereof, space necessary for replacing a disposable member, for example, a developer supply container, etc.). Moreover, there is the restriction regarding the visibility of a developer supply container and the developer supplying unit during the mounting of the developer supply container, and/or the posture which an operator is required to assume to mount a developer supply container into the main assembly, or remove it therefrom, that is, whether or not a user can replace a developer supply container while standing upright. In other words, there are various restrictions regarding the design of the main assembly of an image forming apparatus, in particular, the direction from which the main assembly of an image forming apparatus can be accessed for the mounting of a developer supply container. From the standpoint of being superior in the posture which a user is required to assume to operate an image forming apparatus, there is high demand for such a design that allows a developer supply container to be mounted into the image forming apparatus main assembly from above.

In other words, the employment of a developer supply container of the cartridge type and the developer supplying unit therefore tends to reduce the main assembly of an image forming apparatus in terms of the latitude in its design: a designer of the main assembly of an image forming apparatus is forced to design the main assembly so that the main assembly can be accessed from above for the installation and replacement of a developer supply container.

Thus, there have been designed various developer supply containers of the cartridge type, which can deal with the concerns regarding the direction from which a developer supply container can be mounted into the main assembly of an image forming apparatus while meeting the above described demands. However, it has been found that they suffer from the following problems.

The first problem is: In order to position the portion of the driving force transmitting mechanism for transmitting the force for opening or closing the aforementioned shutter, and the portion of the driving force transmitting mechanism for receiving the force for driving the aforementioned stirring member, on the same side (surface) of a developer supply container, it is necessary for the two driving transmitting mechanisms of the main assembly of an image forming apparatus to be placed close to each other. Thus, this design is limited in terms of the extent of size reduction, in consideration of the interference among the driving force transmission mechanisms on the main assembly side, and the like factors. Further, the developer supply container side has a problem similar to the above described problem of the main assembly. That is, it is extremely difficult to position the two driving force transferring portions, that is, the stirring member driving force receiving portion and shutter driving force transmitting portion, of a developer supply container, on one of the surfaces of the developer supply container designed for compactness, while taking into consideration the interference between the stirring member driving force receiving portion and shutter driving force transmitting portion of the developer supply container, and the driving mechanism on the main assembly side, which is likely to occur during the installation or removal of the developer supply container.

The second problem is: The image forming apparatus and developer supply containers were structured so that the developer supply containers are mounted into the main assembly of an image forming apparatus from such a direction that as they are mounted into the main assembly, they are subjected to the reactive forces which occur in each of the driving portions. Therefore, in order to prevent such operational errors as pulling a developer supply container out of the main assembly when opening or closing the shutter after the mounting of the developer supply container into the main assembly, or while the stirring member is receiving the force for driving it, it was necessary to provide an independent means for regulating the movement of a developer supply container in the direction in which a developer supply container is to be removed from, or mounted into, the main assembly. In particular, in the case that the transmission of driving force is accomplished by the meshing of the meshing of the gears, as the driving force is transmitted from one gear to the other, reactive force is generated in the direction to separate the two gears (in the direction to increase the distance between the rotational axes of the two gears). Therefore, unless the shifting of the two gears is regulated, it is possible that tooth skipping or the like occurs between the two gears, inviting such problems as unsatisfactory stirring of the developer, unsatisfactory opening of the shutter, or the like.

For example, in the case of a developer supply container such as the one disclosed in the referential document quoted in the background technology section of this document, when the stirring member is rotationally driven, and also, when the shutter is opened or closed, a developer supply container is subjected to the reactive force which is generated by the driving portions in the direction perpendicular to the direction in which a developer supply container is mounted into the main assembly. However, this movement of a developer supply container, which is likely to be caused by the abovementioned reactive force from the driving portion as soon as the developer supply contain is mounted, can be prevented by the guides or the like, with which the developer supply container accommodating portion of the main assembly is provided. Therefore, problems such as the above described ones did not occur.

DISCLOSURE OF THE INVENTION

Thus, the primary object of the present invention is to provide a developer supply container which is mounted in the main assembly of an image forming apparatus from such a direction that as the developer supply container is mounted into the main assembly, it is subjected to the reactive forces from the developer supply container driving portions, and yet, is simple and compact in structure, and reliable in operation, and an image forming apparatus which employs such a developer supply container.

According to an aspect of the present invention, there is provided a developer supply container for supplying developer to a developer receiving portion of a main assembly of the image forming apparatus of an electrophotographic type, said developer supply container being mountable to a main assembly of the image forming apparatus, said developer supply container comprising: a developer accommodating portion for accommodating a developer; a discharge opening for permitting discharge of the developer; a stirring member for stirring the developer in said developer accommodating portion; a stirring drive receiving portion, provided in one of opposing sides of said developer supply container, for receiving a stirring driving force for driving said stirring member from a stirring drive transmitting portion provided in the main assembly of the image forming apparatus and for transmitting the stirring driving force to said stirring member; an openable member movable to open and close said discharge opening; an opening and closing drive receiving portion, provided in the openable member, for receiving an opening and closing driving force for moving said openable member; an opening and closing drive transmitting portion, provided in the other of the opposing sides, for transmitting an opening and closing driving force to said opening and closing drive receiving portion through an opening and closing driving relay portion provided in the main assembly of the image forming apparatus; wherein by mounting said developer supply container to the main assembly of the image forming apparatus, drive force transmittable engagements are established between said stirring drive transmitting portion and said stirring drive receiving portion, between said opening and closing drive transmitting portion and said opening and closing driving relay portion, and between said opening and closing driving relay portion and said opening and closing drive receiving portion, respectively, so that stirring driving force is transmittable from said stirring drive transmitting portion to said stirring drive receiving portion, and the opening and closing driving force is transmittable from said opening and closing drive transmitting portion to said opening and closing drive receiving portion, and wherein a mounting direction in which said developer supply container is mounted to the main assembly of said image forming apparatus is against a force received by said developer supply container from the main assembly of the image forming apparatus; an engaging portion, provided adjacent each of said sides, for limiting movement of said developer supply container in a dismounting direction by engagement with a locking portion provided in the main assembly of the image forming apparatus when said developer supply container is mounted to the main assembly of the image forming apparatus.

According to another aspect of the present invention, there is provided an image forming apparatus comprising: an image forming station for forming an image with a developer; a mounting portion for mounting a developer supply container accommodating a developer to be supplied to said image forming station; a developer receiving portion for receiving the developer supplied through a discharge opening of said developer supply container; a stirring drive transmitting portion for transmitting a stirring driving force for driving a stirring member provided in said developer supply container to a stirring drive receiving portion provided in one of opposing sides of said developer supply container; an opening and closing drive transmitting portion for transmitting an opening and closing driving force for moving an openable member provided in said developer supply container to open and close said discharge opening, the opening and closing drive transmitting portion is provided in the other one of the sides, an opening and closing driving relay portion for receiving the opening and closing driving force from said opening and closing drive transmitting portion and transmitting the opening and closing driving force to an opening and closing drive receiving portion provided in said openable member, wherein by mounting said developer supply container to the main assembly of the image forming apparatus, drive force transmittable engagements are established between said stirring drive transmitting portion and said stirring drive receiving portion, between said opening and closing drive transmitting portion and said opening and closing driving relay portion, and between said opening and closing driving relay portion and said opening and closing drive receiving portion, respectively, so that stirring driving force is transmittable from said stirring drive transmitting portion to said stirring drive receiving portion, and the opening and closing driving force is transmittable from said opening and closing drive transmitting portion to said opening and closing drive receiving portion, and wherein a mounting direction in which said developer supply container is mounted to the main assembly of said image forming apparatus is against a force received by said developer supply container from the main assembly of the image forming apparatus; a locking portion, provided adjacent each of portions which are opposed by the sides when said developer supply container is mounted to said apparatus, for limiting movement of said developer supply container in a dismounting direction by engagement with an engaging portion of said developer supply container.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

Hereinafter, one the preferred embodiments of the present invention will be described with reference to the appended drawings.

(General Structure)

Figure 4:
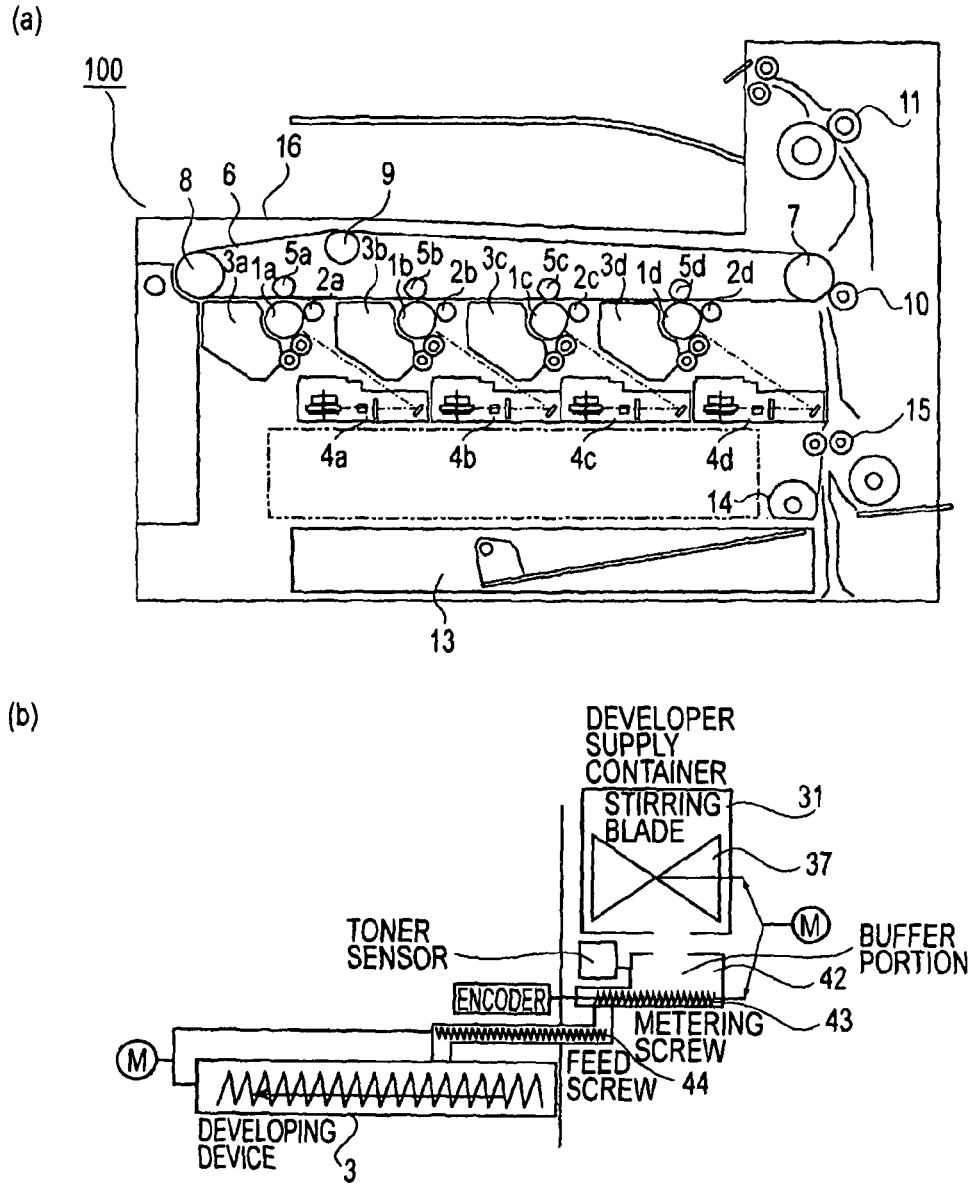
FIG. 4(*a*) is a schematic sectional view of the main assembly of the image forming apparatus, showing the general structure of thereof, and FIG. 4(*b*) is a schematic drawing showing the portions and paths through which developer is conveyed.
Figure 5:
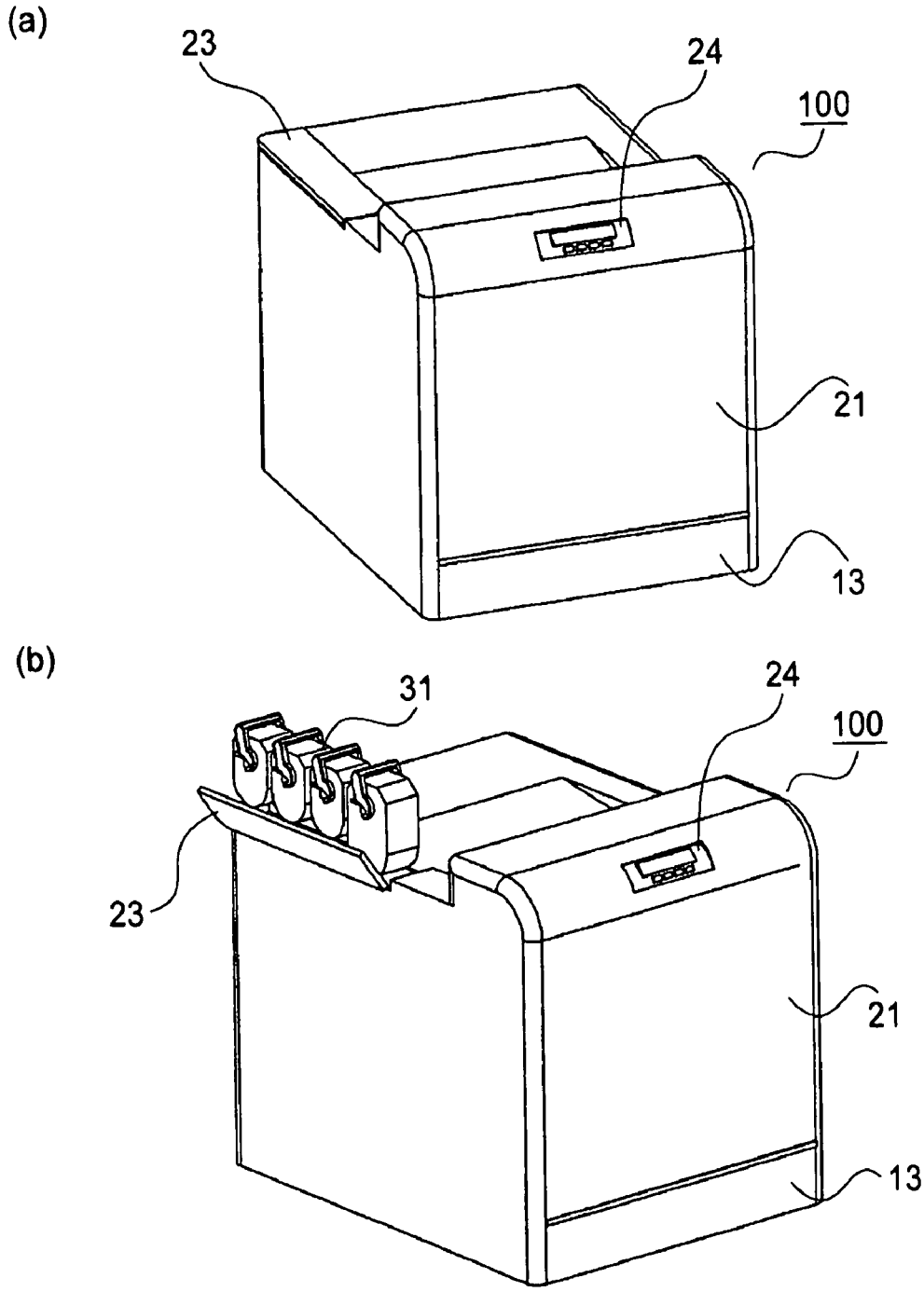
FIGS. 5(*a*) and 5(*b*) are external perspective views of the main assembly of the image forming apparatus.

The main assembly 100 of the image forming apparatus, and the developer supply container 31 mountable in the image forming apparatus main assembly 100, in one of the preferred embodiments of the present invention, will be described referring to the drawings. First, referring to FIGS. 4 and 5, the general structure of the image forming apparatus main assembly 100 will be described. FIG. 4(*a*) is a schematic sectional view of the image forming apparatus main assembly 100 in this embodiment of the present invention, as seen from the left side of the apparatus, and FIG. 4(*b*) is a schematic drawing showing the portions and paths through which developer is conveyed from the developer supply container 31 to the image forming apparatus main assembly 100. FIG. 5(*a*) is an external perspective view of the main assembly of the image forming apparatus, and FIG. 5(*b*) is an external perspective view of the image forming apparatus main assembly 100, which is in the process of replacing the developer supply containers 30.

In FIG. 4(*a*) which shows the image forming apparatus main assembly 100, the right side is the front side of the apparatus. Referring to FIG. 5(*a*), the image forming apparatus main assembly 100 is provided with a control panel 24 with a display, which is located in the top portion of the image forming apparatus main assembly 100, an external cover 21 which is to be opened to expose the recording medium conveyance passage to deal with paper jams or the like, and a recording medium feeder cassette 13, which is operable from the front side of the apparatus.

The image forming apparatus main in this embodiment is a full-color printer (of in line type) capable of forming a multicolor images. As for the internal structure thereof, its main assembly is provided with four photosensitive drums as image bearing members, that is, photosensitive drums 1*a*, 1*b*, 1*c*, and 1*d*, one for each of the four primary colors, which are disposed in tandem in a straight line. The employment of the four photosensitive drums enables the image forming apparatus to form an image at a higher rate of speed. It is also provided with an intermediary transfer belt 6 as an intermediary transferring member onto which the images formed on the photosensitive drums one for one are transferred in layers. It is also provided with developing devices 3*a*-3*d* which contain the developers delivered from the developer supply containers 31. The photosensitive drums 1*a*, 1*b*, 1*c*, and 1*d*, and the developing devices 3*a*-3*d*, are disposed directly below the intermediary transfer belt 6, being aligned roughly in horizontal straight lines. They correspond to yellow, magenta, cyan, and black colors, one for one.

The photosensitive drums 1*a*-1*d* are uniformly charged by charging apparatuses 2*a*-2*d*, respectively, and then, are exposed by the exposing apparatuses 4*a*-4*d*, respectively, effecting thereby a latent image on each of the four photosensitive drums. The latent images are developed by the developing devices 3*a*-3*d* into images formed of toner (which hereinafter will be referred to as toner images), which are different in color. The toner images on the photosensitive drums 1*a*-1*d* are transferred (primary transfer) in layers by primary transfer rollers 5*a*-5*d* onto the intermediary transfer belt 6, effecting thereby a full-color toner image. The intermediary transfer belt 6 is stretched around a driver roller 7, a follower roller 8, and a tension roller 9, and is circularly driven. The toner images on the intermediary transfer belt 6 are transferred (secondary transfer) by a secondary transfer roller 10 onto a sheet of recording medium. The sheet of recording medium is picked up by a pickup roller 14 from a sheet feeder cassette 13, and then, is fed into the main assembly by the pickup roller 14. Then, the sheet of recording medium is conveyed by a pair of registration rollers 15 to the secondary transfer portion, with the rotation of the registration rollers 15 synchronized with the movement of the intermediary transfer belt 6. After the transfer of the color toner image onto the sheet of recording medium, heat and pressure are applied to the sheet of recording medium and the toner images thereon by a fixing device 11, fixing thereby the color toner images to the sheet of recording medium. Then, the sheet of recording medium is discharged from the image forming apparatus main assembly 100.

Figure 3:
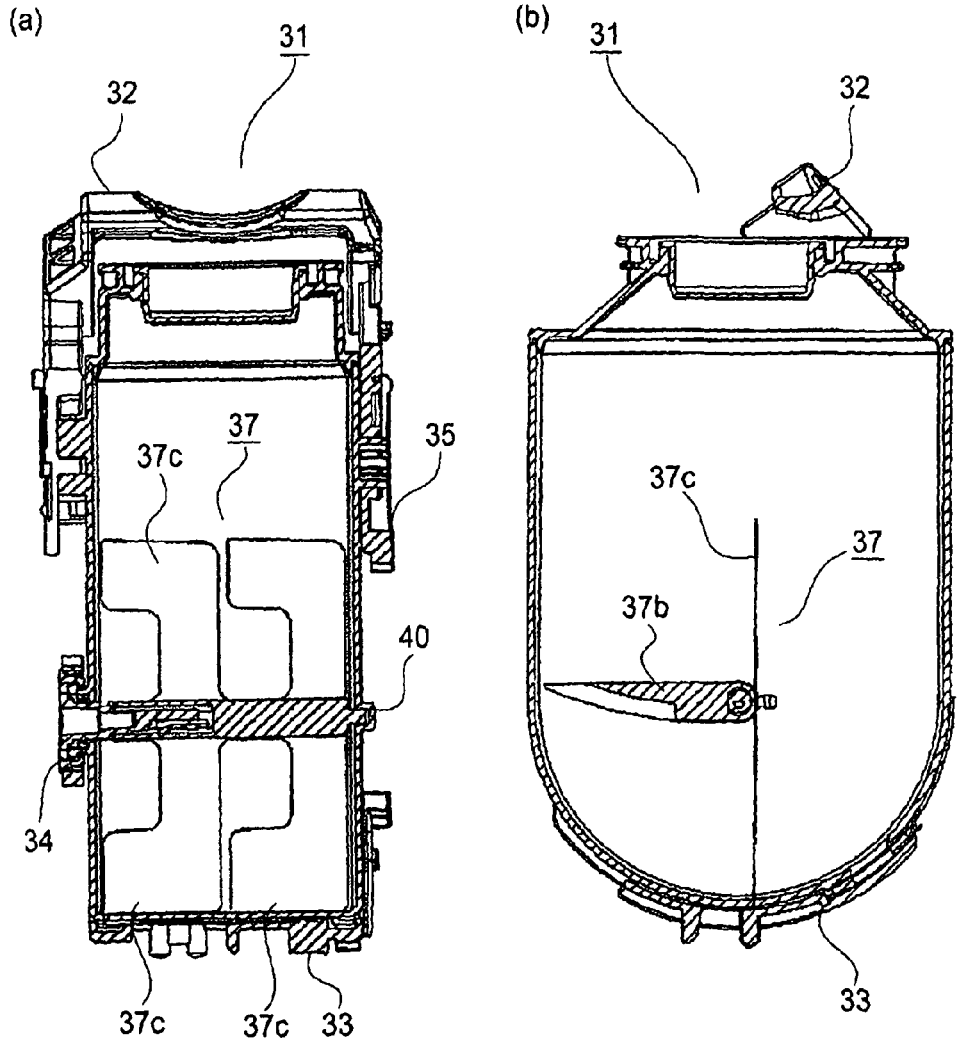
FIGS. 3(*a*) and 3(*b*) are sectional views of the developer supply container.

The image forming apparatus employs four developer supply containers 31*a*-31*d* filled with four brand-new supplies of toner, one for one, different in color, which are to be mounted in the image forming apparatus main assembly 100. Referring to FIG. 4(*b*), each of the developer supply containers 31 is provided with a stirring member 37, which is disposed within the developer supply container 31 (FIG. 3). The stirring member 37 will be described later in more detail. As the stirring member 37 is rotated, the developer in the developer supply container 31 is discharged through the developer outlet 38 (FIG. 9) of the developer supply container 31, and is accumulated in a buffer portion 42, the bottom portion of which is provided with a developer amount measurement screw 43 and a developer conveyance screw 44, being thereby enabled to send the developer therein into a process cartridge. As the developer is conveyed by the developer amount measurement screw 43, the body of developer is separated into smaller bodies of developer, which are equal in size. Since the volume of each of the small bodies of developer is determined by the pitch of the screw 43 and the spaces formed by the screw 43 and internal surface of the cylindrical portion of the buffer portion 42, the amount by which the developer is discharged from the buffer portion 42 can be adjusted by controlling the number of times the screw 43 is rotated.

Because of the user s desire to reduce the amount of the space which the image forming apparatus main assembly 100 occupies, it is desired that the image forming apparatus main assembly 100 is designed to be compact, as described above. Therefore, each of the above described components must be designed to be compact, and also, capable of being positioned in a spatially efficient manner. In particular, in the case of a full-color image forming apparatus such as the one in this embodiment, not only must the four developer supply containers 31 be placed in the image forming apparatus main assembly, but also, the four portions 17 for accommodating the four developer supply containers 31, one for one, and the four driving force transmission mechanisms, etc., must be placed in the image forming apparatus main assembly 100. Therefore, a spatially efficient design is very important.

The main assembly of the full-color image forming apparatus in this embodiment was designed in consideration of such a requirement that not only must it be small in the space which it occupies, but also, in the amount of the space it requires for the replacement of the developer supply containers 31 (for example, space necessary to open cover of main assembly, and space necessary for mounting developer supply containers 31). Thus, it employs the design in which it is from above the image forming apparatus main assembly 100 that the developer supply containers 31 are to be mounted into the image forming apparatus main assembly 100.

The employment of the design that allows the developer supply container accommodating portion to be accessed from above the image forming apparatus main assembly is preferable from the standpoint of operability. For example, it makes it easier for a user to see the developer supply container accommodating portion as well as the developer supply container(s) 31, and also, allows a user to remain standing upright, while replacing the developer supply container(s) 31.

(Developer Supply Container)

Figure 1:
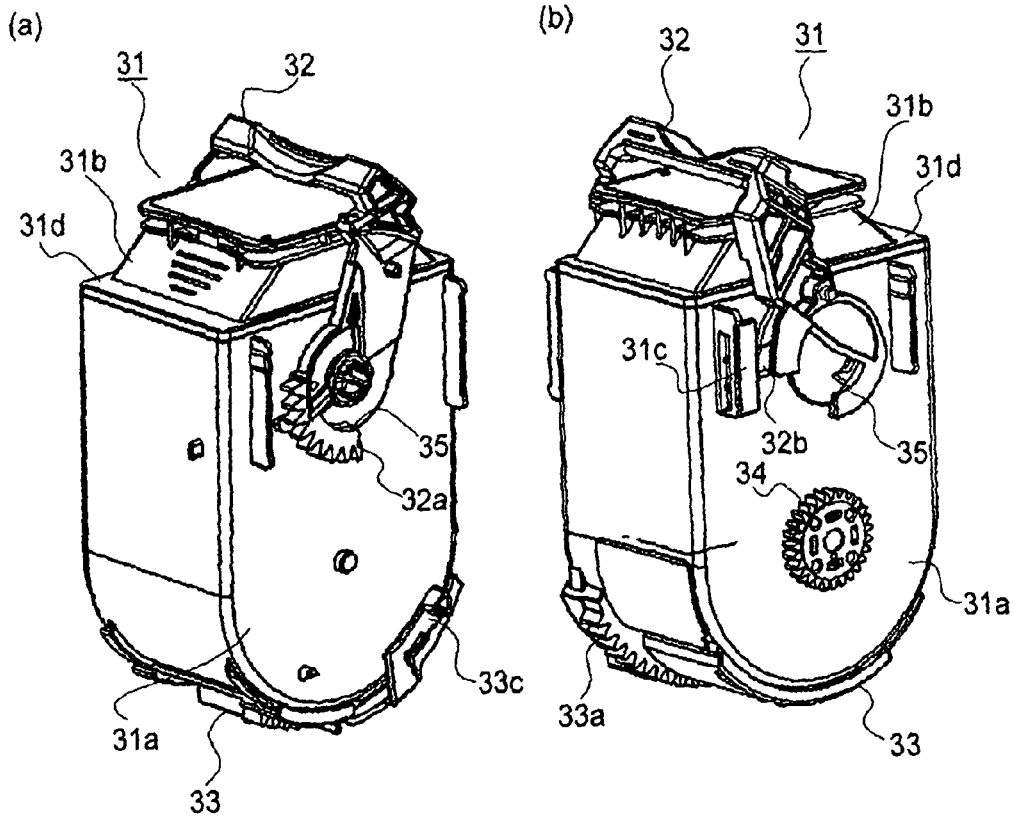
FIG. 1 is an external perspective view of the developer supply container in the preferred embodiment of the present invention.
Figure 2:
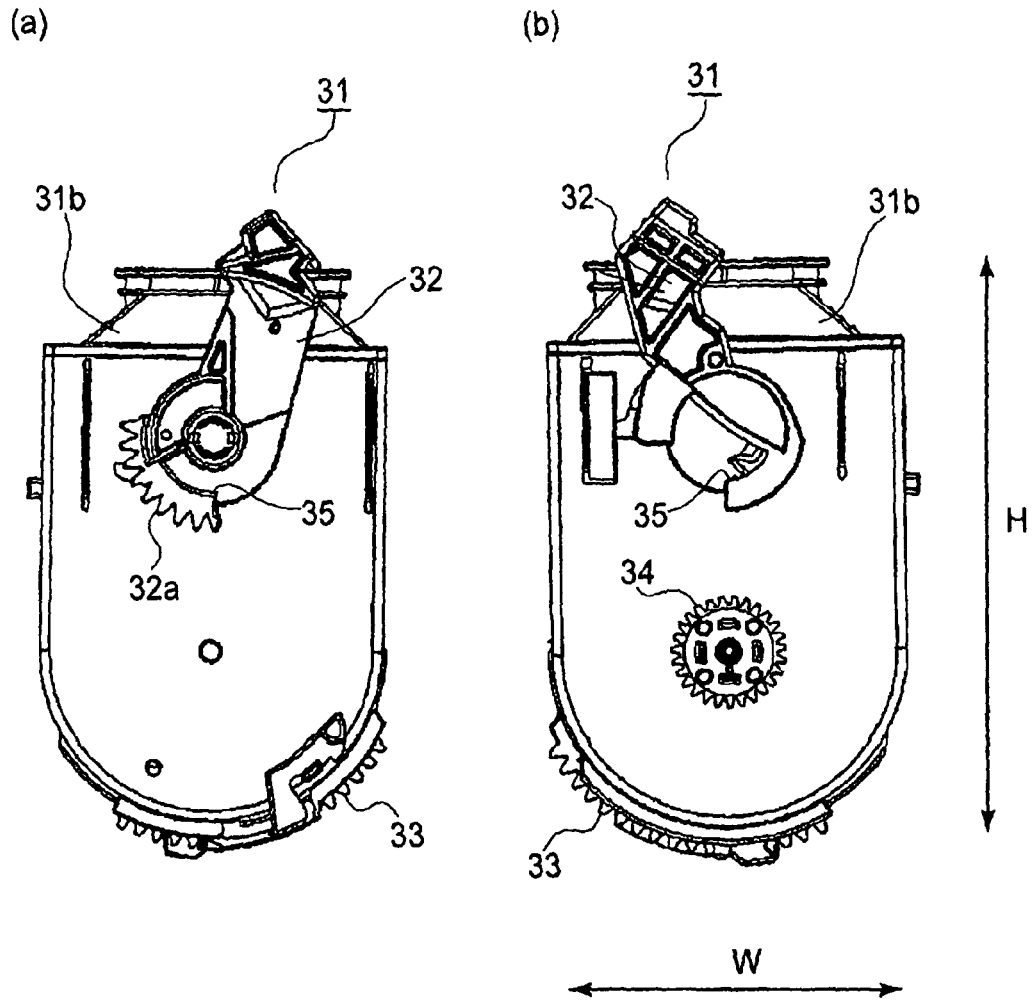
FIGS. 2(*a*) and 2(*b*) are front and rear views, respectively, of the developer supply container.

Next, referring to the drawings, the developer supply container 31 in this embodiment will be described. FIG. 1 is an external perspective view of the developer supply container 31 in this embodiment of the present invention: FIG. 1(*a*) is an external perspective view of the developer supply container 31, inclusive of the front side, and FIG. 1(*b*) is an external perspective view of the developer supply container 31, inclusive of the rear side. FIGS. 2(*a*) and 2(*b*) are front and rear views of the developer supply container 31, respectively. FIG. 3(*a*) is a vertical sectional view of the developer supply container 31, at a plane perpendicular to the front view of the developer supply container 31 in FIG. 2(*a*), and FIG. 3(*b*) is a sectional view of the developer supply container 31, at a plane parallel to the front view of the developer supply container 31 in FIG. 2(*a*).

Each of the developer supply containers 31 is mounted into the apparatus main assembly 100, and left therein. It gradually discharges the developer therein into the developer receiving portion of the apparatus main assembly 100 until it becomes depleted of the developer therein. In other words, the developer supply container 31 is of the so-called cartridge type. When it is mounted into the image forming apparatus main assembly 100, it is to be kept in the position shown in the drawings.

Referring to FIG. 1, the developer supply container 31 in this embodiment comprises a container proper 31*a*, in which developer is stored, and a cap portion 31*b*, which is attached to container proper 31*a* with the use of one of the known means, for example, ultrasonic welding. It also comprises: a lever 32; the developer outlet 38 (FIG. 9) which is located in the bottom wall portion of the developer supply container 31 to discharge the developer; and a developer outlet shutter 33 which is enabled to unsealably seal the developer outlet 38. Further, it is provided with the stirring member 37, which is disposed in the container proper 31*a*, and rotates by receiving driving force from the image forming apparatus main assembly 100.

Next, each of the abovementioned components of the developer supply container 31 will be described in detail.

(External Shape of Developer Supply Container)

First, the configuration of the developer supply container 31 will be described in detail. Referring to FIG. 1 and the like, the developer supply container 31 is a hollow container, and its bottom portion is semicylindrical, whereas its top portion is in the form of a rectangular parallelepiped, the width of which is roughly equal to the diameter of the semicylindrical bottom portion. It is roughly 90 mm in width (which is equal to diameter of semicylindrical bottom portion and is designated by referential symbol W in FIG. 2(*b*)), roughly 135 mm in height (which is designated by referential symbol H in FIG. 2(*b*)). In other words, it is structured so that the ratio between its width and height is roughly 1:15. Next, referring to FIG. 3, the stirring member 37, which will be described later in detail, is disposed roughly in the center of the internal space of the semicylindrical bottom portion of the developer supply container 31, being rotatably supported by its axis to convey the developer in the developer supply container 31 while stirring it. Further, the semicylindrical wall of the semicylindrical bottom portion of the developer supply container 31 is provided with the aforementioned developer outlet 38, through which the developer in the developer supply container 31 is discharged to supply the image forming apparatus main assembly 100 with the developer in the developer supply container 31. The location of the developer outlet 38 relative to the semicylindrical wall portion is roughly at the center of the developer supply container 31 in terms of the direction parallel to the axial line of the stirring member 37, and is at roughly 30° from the plane which coincides with the axial line of the stirring member 37. The developer outlet 38 is roughly 20 mm wide in terms of the direction parallel to the rotational axis of the stirring member 37, and roughly 10 mm in terms of the direction parallel to the rotational direction of the stirring member 37.

Incidentally, the width and height of the developer supply container 31 are not limited by the gist of the present invention. However, in the case in which a stirring wing such as the stirring wing 37*c* employed in this embodiment of the present invention, which is made up of only a flexible member, is used as the developer stirring portions of the stirring member 37, if the distance from the rotational axis of the stirring member 37 to the internal surface of the semicylindrical portion of the developer supply container 31 is increased greater than a certain value, the flexible member which constitutes the stirring wing 37*c* becomes insufficient in rigidity, possibly allowing the stirring member 37 to reduce in developer conveyance performance as well as developer stirring performance. Therefore, the distance from the rotational axis of the stirring member 37 to the internal surface of the semicylindrical portion of the developer supply container 31 is desired to be no more than 300 mm. This, however, does not apply if each of the stirring wings 37 is provided with a rib 37*b* which extends from the stirring member shaft 37*a* (FIG. 3(*b*)), instead of forming the stirring wings 37*c* of only the flexible members, in order to compensate for the insufficient rigidity of the stirring wings 37.

In the case of an image forming apparatus such as the one in this embodiment which requires multiple developer supply containers, the number of which matches the four primary colors, its design is desired to be altered according to the manner of its usage (ratio between monochromatic and multicolor prints). For example, if the apparatus is expected to be used more frequently for printing monochromatic images than multicolor images, the developer supply container for black developer should be increased in size.

As for the positioning and size of the developer outlet 38, they are desired to be determined according to the restrictions placed on the design of the image forming apparatus main assembly 100, properties of the developer to be stored in the developer supply container 31, and the like factors. They are not limited by the gist of the present invention.

(Stirring Member)

Referring to FIG. 3, the stirring member 37 in this embodiment is made up of the stirring member shaft 37*a* and multiple stirring wings 37*c* attached to the shaft 37*a*. It is disposed in the developer supply container 31 as shown in the drawing.

Referring to FIG. 3(*a*), the stirring member shaft 37*a* is in the form of a rod, one end of which is provided a receptacle portion (portion with hole) in which a coupler is inserted, with the wall of the developer supply container 31 interposed between the coupler and the receptacle portion. The coupler also plays the role of a stirring member driving force receiving portion 34 for transmitting the stirring member driving force from the image forming apparatus main assembly 100 to the stirring member 37. That is, as the developer supply container 31 is inserted into the image forming apparatus main assembly 100, the coupler engages with one of the gears of the stirring member driving mechanism 20 (FIG. 10) of the image forming apparatus main assembly 100, and rotates the stirring member 37 by receiving the driving force from the gear of the stirring member driving mechanism 20. The other end of the stirring member shaft 37*a* is inserted in the stirring member shaft supporting hole 40 with which the wall of the developer supply container 31 is provided. As for the method for attaching the stirring wings 37*c* to the stirring member shaft 37*a*, one of the known methods may be employed, for example, snapping-fasteners, thermal crimping, screws, etc.

Next, referring to FIG. 3(*b*), the stirring member shaft 37*a* is provided with projections 37*b* for loosening the developer as the stirring member 37 is rotated. With the function of these projections 37*b*, even if the developer in the developer supply container 31 becomes compacted due to the vibrations or the like which occur during the distribution of the developer supply container 37 (air is forced out of body of developer, allowing body of developer to be compacted), the compacted body of developer is sufficiently loosened to be discharged from the developer supply container 31 by the amount which meets the demand for the developer by the image forming apparatus main assembly 100. The shape of the projection 37*b* is not restricted by the gist of the present invention. That is, it should be determined according to the properties of the developer to be filled into the developer supply container 31, the torque limit of the motor of the image forming apparatus main assembly 100, and the like factors.

The stirring wings 37*c* are formed of a plate of flexible substance. As for the substance suitable as the material for the stirring wings 37*c*, such a substance that possesses a proper amount of resiliency and is resistant to creeping is usable, for example, a sheet of polyacetal or polyurethane rubber, rubber coated fabric, etc. However, the preferable material is polyester (PET) film. In this embodiment, PET film is used. The thickness of polyester film may be set according to the size of the developer supply container 31 (in particular, diameter of its semicylindrical bottom portion), the type of the developer to be stored in the developer supply container 31, the shape of the stirring wings 37*c*, which will be described later in detail. However, it is desired to be roughly 50-500 μm, preferably 150-300 μm. Incidentally, if the thickness of the stirring wings 37*c* is reduced to a value less than 50 μm, the stirring wings 37*c* become too low in rigidity, reducing thereby the stirring member 37 in developer conveyance performance, and the strength of the joint between the stirring wings 37*c* and stirring member shaft 37*a*. Further, they become more difficult to handle when assembling the stirring member 37.

Therefore, reducing the thickness of the stirring wings 37*c* to a value smaller than 50 μm is not desirable. On the other hand, if the thickness of the stirring wings 37*c* is increased to a value greater than 500 μm, the stirring wings 37*c* become too rigid, requiring therefore a greater amount of torque to be rotated in the container proper 31*a*. Further, the increase in the rigidity of the stirring wings 37*c* results in the increase in the amount of friction between the stirring wings 37*c* and the developer, damaging thereby the developer, which may result in the formation of coarse developer particles. Moreover, if the stirring wings 37*c* are increased in thickness to a value greater than 500 μm, they become difficult to deform, creating such a problem that they make it difficult to assemble the stirring member 37. In this embodiment, a sheet of 188 μm thick film is used as the material for the stirring wings 37*c*. As for the method for processing the material for the stirring wings 37*c* to form the stirring wings 37*c*, the manufacturing the stirring wings 37*c* by punching the material with the use of a press is preferable, because it is highly precise and inexpensive. The developer supply container 31 is structured so that as the stirring wings 37*c* are rotated with the stirring member shaft 37*a*, within the container proper 31*a*, the developer in the container proper 31*a* is conveyed, while being stirred, toward the developer outlet 38, and then, is discharged from the container proper 31*a*.

(Shutter)

Figure 6:
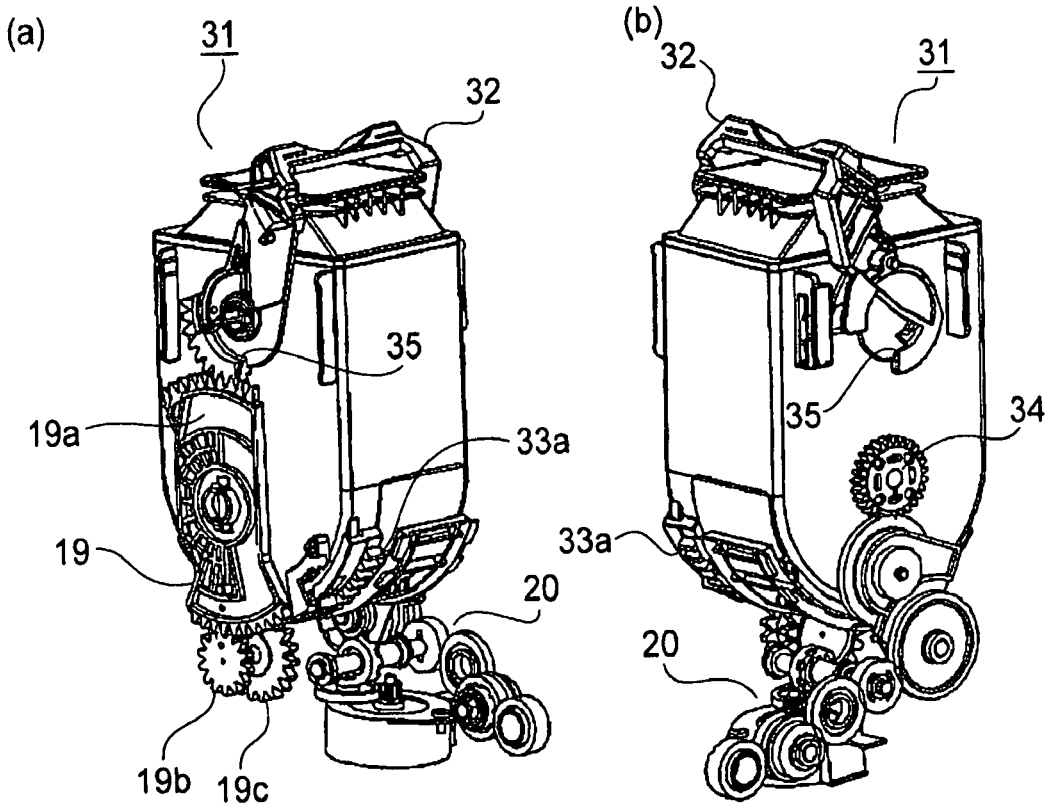
FIGS. 6(*a*) and 6(*b*) are perspective views of the developer supply container and developer supply container driving force transmitting portion of the main assembly, which are in engagement with each other.
Figure 7:
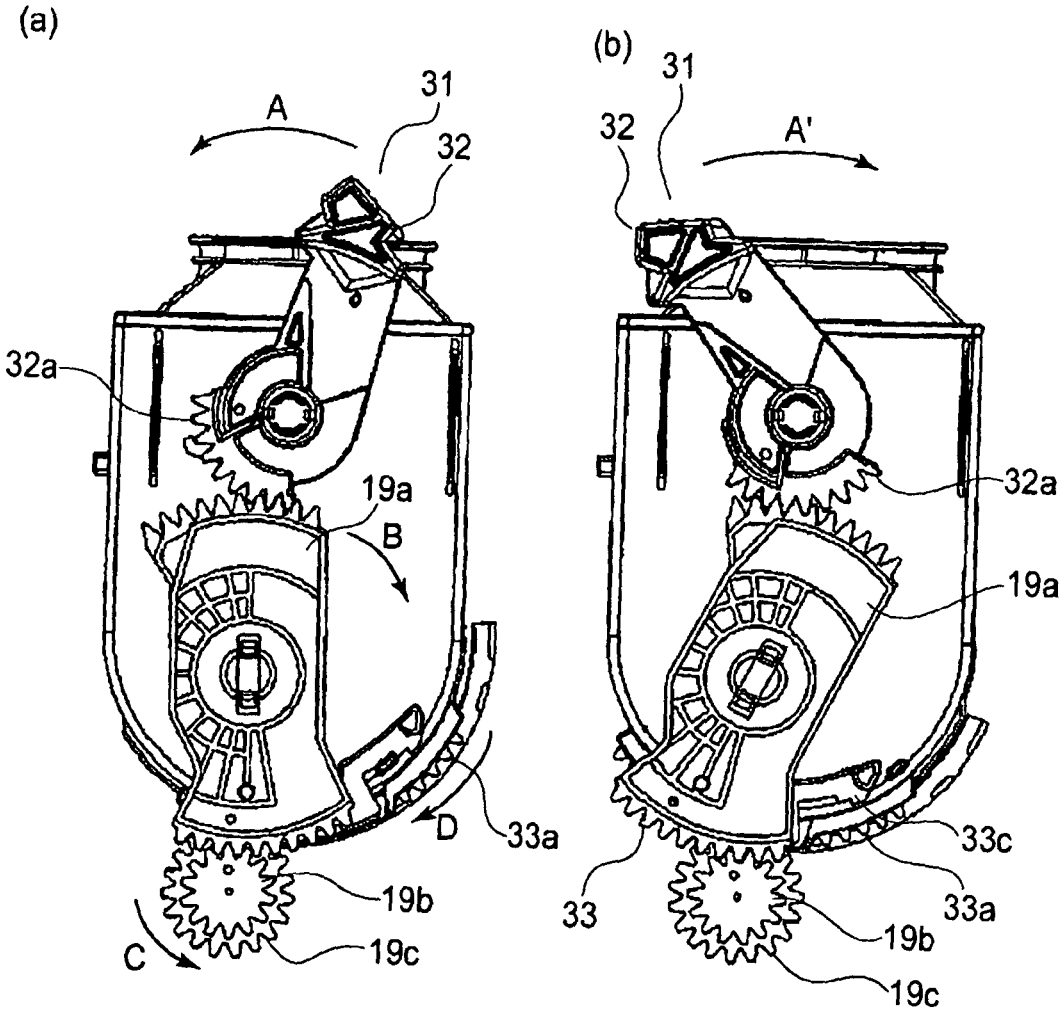
FIGS. 7(*a*) and 7(*b*) are schematic drawings of the developer supply container, showing the operation for opening the shutter of the developer supply container and the operation for closing it, respectively.
Figure 8:
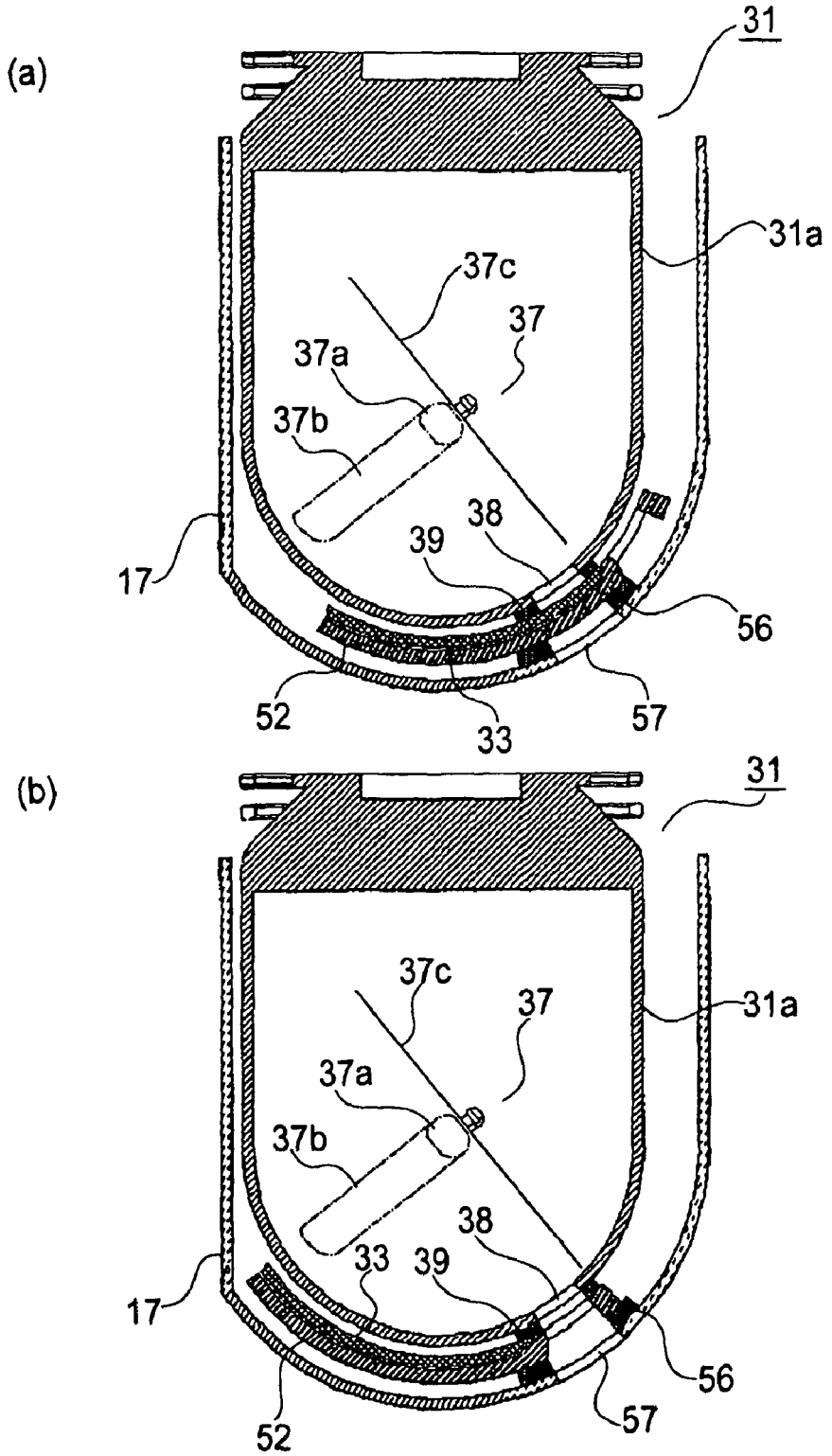
FIGS. 8(*a*) and 8(*b*) are schematic sectional views of the developer supply container, showing the operation for opening the shutter of the developer supply container and the operation for closing it, respectively.
Figure 9:
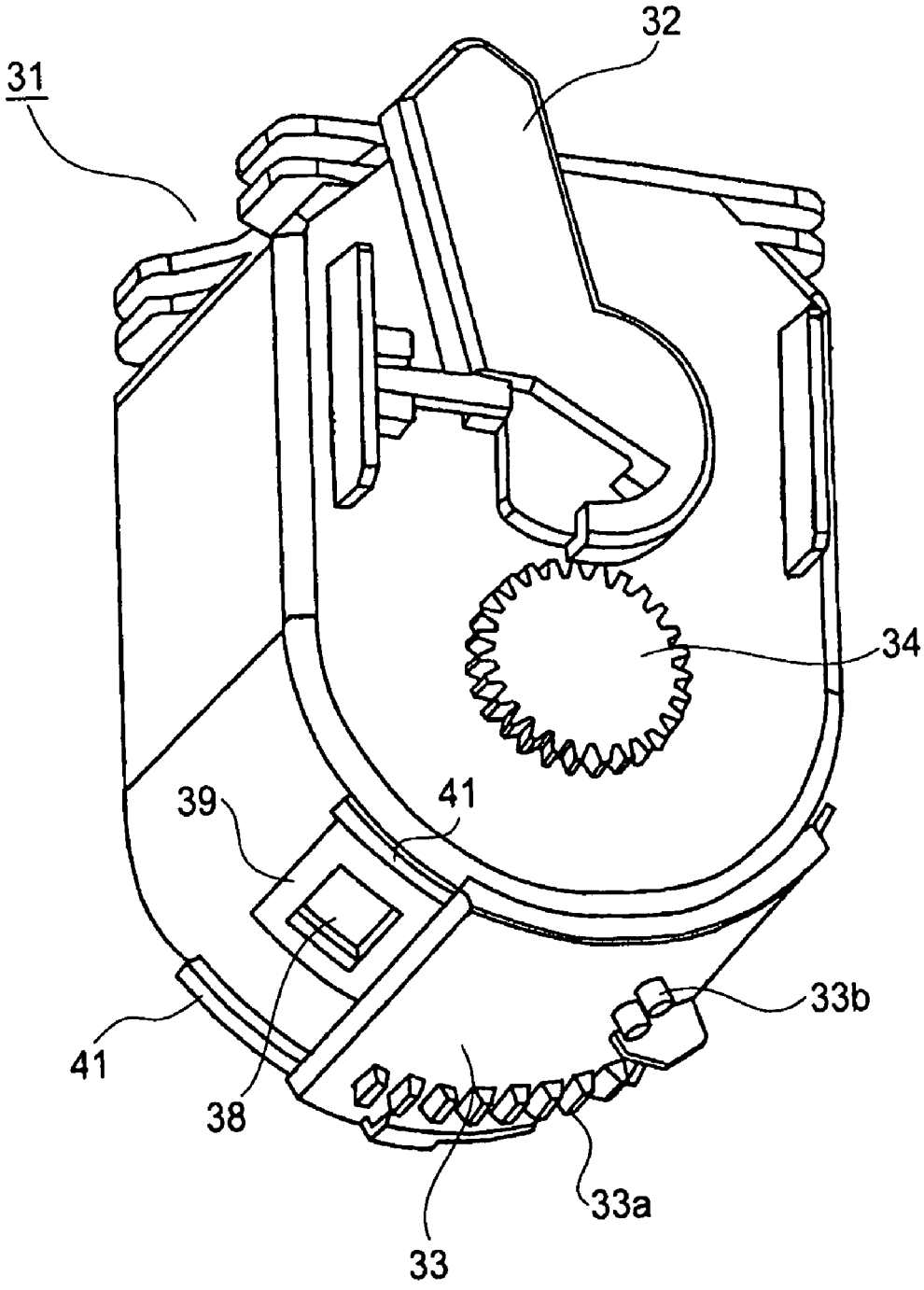
FIG. 9 is a perspective view of the developer supply container, as seen from the bottom side, the shutter of which is open.

Next, referring to FIGS. 6-9, the shutter 33 will be described in detail. FIG. 6 shows the developer supply container 31 in this embodiment of the present invention, which is in engagement with the developer supply container driving mechanism on the main assembly side in this embodiment: FIG. 6(*a*) is an external view of the shutter driving force transmitting side of the developer supply container 31, and FIG. 6(*b*) is an external view of the stirring member driving force receiving side of the developer supply container 31. FIG. 7 is a drawing for describing the operation of the shutter driving force transmission mechanism for opening or closing the shutter 33: FIG. 7(*a*) shows the state of the mechanism in which the shutter 33 is shut, whereas FIG. 7(*b*) shows the state of the mechanism in which the shutter 33 is open. FIG. 8 is a sectional view of the developer supply container 31, showing the operation of the shutter driving force transmission mechanism for opening the shutter 33, inclusive of the movements on the side of the developer supply container accommodating portion 17: FIG. 8(*a*) shows the state of the mechanism in which the shutter 33 is shut, whereas FIG. 8(*b*) shows the state of the mechanism in which the shutter 33 is open. FIG. 9 is a perspective view of the developer supply container 31, as seen from below, with its shutter 33 open.

Referring to FIG. 9, the shutter 33 is in engagement with a pair of guide rails 41, which are disposed on both sides of the developer outlet 38 in terms of the direction parallel to the rotational axis of the stirring member 37, being structured to slide along the guide rails 41 in the circumferential direction of the semicylindrical portion of the developer supply container 31 to seal or unseal the developer outlet 38.

Next, referring to FIGS. 8 and 9, the shutter 33 is provided with a pair of engagement projections 33*b* which engage with a shutter 52, with which the apparatus main assembly 100 is provided. The shutter 33 is structured so that as the developer supply container 31 is mounted into the apparatus main assembly 100, the engagement projections 33*b* engage with the shutter 52 of the apparatus main assembly 100 so that the shutter 52 moves with the shutter 33. Therefore, as the shutter 33 is moved, with the use of the method, which will be described later, to unseal or seal the developer outlet 38 as shown in FIG. 8(*a*) or FIG. 8(*b*), the shutter 52 of the apparatus main assembly 100 also moves with the shutter 33, unsealing or sealing thereby the developer inlet 57 of the apparatus main assembly 100. In other words, when the shutter 33 is open, the shutter 52 of the apparatus main assembly 100 is also open, keeping thereby the developer inlet 57 unsealed, as shown in FIG. 8(*b*), and therefore, the developer outlet 38 of the developer supply container 31 becomes and remains connected to the developer inlet 57 of the apparatus main assembly 100, allowing the developer supply container 31 to supply the apparatus main assembly 100 with the developer in the container 31. On the other hand, as the shutter 33 is closed, the shutter 52 of the apparatus main assembly 100 also closes, sealing thereby the developer inlet 57 of the apparatus main assembly 100, making it thereby possible to remove or mount the developer supply container 31.

Next, referring to FIGS. 6 and 7, the operation for opening or closing the shutter 33 will be described in detail. The shutter 33 is provided with a shutter driving force receiving portion 33*a*, which engages with the large gear 19*c* of the shutter driving force relaying portion 19 (stepped gear) with which the apparatus main assembly 100 is provided. The shutter driving force relaying portion 19 is provided with a small gear 19*b* which is coaxial with the large gear 19*c*. The small gear 19*b* is in engagement with an idler gear 19*a*, which is in engagement with a lever 32, which will be described later. With the provision of the above described arrangement, as the lever 32 is operated, the shutter 33 is moved as shown in FIG. 7(*a*) or 7(*b*).

The shutter 33 is also provided with a lock portion 33*c* (FIG. 1) for regulating the movement of the shutter 33, which is caused by the erroneous operation of the shutter 33. The lock portion 33*c* prevents the shutter 33 from accidentally opening during the shipment of the developer supply container 31, the handling of the developer supply container 31 by a user, or the like situations. As the developer supply container 31 is mounted into the image forming apparatus main assembly 100, the lock portion 33*c* is interfered with by a rib-like projection (unshown) with which the image forming apparatus main assembly 100 is provided, being thereby caused to retract upward, allowing thereby the shutter 33 to be moved.

(Lever)

Also referring to FIGS. 6 and 7, the lever 32 will be described in detail. The lever 32 is a member which is movably attached to the developer supply container 31. It is provided with a shutter driving force transmission portion 32*a* for transmitting the force generated as a user moves the lever 32, to the idler gear 19*a*. Thus, as a user mounts the developer supply container 31 into the image forming apparatus main assembly 100, and operates the lever 32, the force generated by the operation is transmitted to the shutter driving force receiving portion 33*a* of the shutter 33, through the shutter driving force relaying portion 19 (idler gear 19*a*, and large and small gears of gear train) on the apparatus main assembly side, to open or close the shutter 33.

Figure 12:
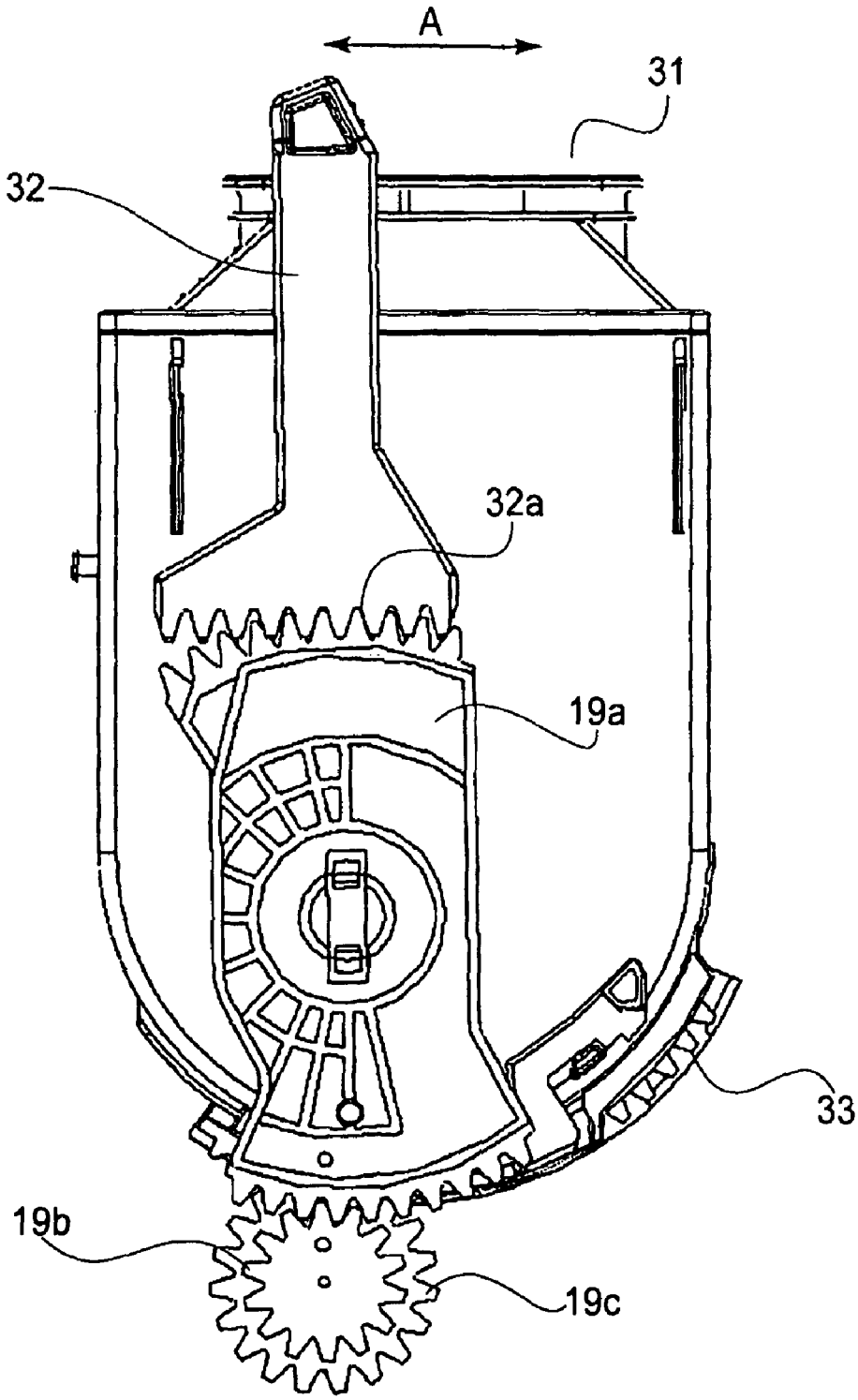
FIG. 12 is an external view of the first modified version of the developer supply container in the preferred embodiment of the present invention.

The abovementioned operations will be described in more detail with reference to FIGS. 7 and 12. FIG. 7 shows the state of the developer supply container 31, in which the shutter driving force transmitting portion 32*a* of the lever 32 is in engagement with the idler gear 19*a* on the main assembly side after the mounting of the developer supply container 31 into the apparatus main assembly 100: FIG. 7(*a*) shows the state of the developer supply container 31, in which the shutter 33 is shut, whereas FIG. 7(*b*) shows the state of the developer supply container 31, in which the shutter 33 is open.

After the insertion of the developer supply container 31 into the image forming apparatus main assembly 100, a user is to rotate the lever 32 in the counterclockwise direction (indicated by arrow mark A in drawing) in FIG. 7. As the lever 32 is rotated in the abovementioned direction, the shutter driving force transmitting portion 32*a* of the lever 32 also rotates in the counterclockwise direction, causing thereby the idler gear 19*a* to rotate in the clockwise direction (indicated by arrow mark B). Since the idler gear 19*a* is in engagement with the small gear portion 19*b* of the stepped gear, the stepped gear is rotated in the counterclockwise direction (indicated by arrow mark C in drawing), causing thereby the large gear 19*c* of the stepped gear, which is coaxial with the small gear 19*b*, to rotate in the counterclockwise direction. As a result, the shutter 33 is rotationally moved in the clockwise direction (indicated by arrow mark D in drawing), unsealing the developer outlet 38 (FIG. 7(*b*) and FIG. 9), because the large gear 19*c* is in engagement with the shutter driving force receiving portion 33*a* of the shutter 33. In order to seal the developer outlet 38, which is in the state shown in FIGS. 7(*b*) and 9, a user is to rotate the lever 32 in the clockwise direction (indicated by arrow mark A' in drawing), which is opposite to the direction in which the lever 32 is to be rotated in the above described operation for unsealing the developer outlet 38. As the lever 32 is rotated in the counterclockwise direction, the shutter 33 is closed through the idler gear 19*a*, and small and large gear 19*b* and 19*c* of the stepped gear. As described above, a user can open or close the shutter 33 by the simple operation of moving the lever 32. In other words, this embodiment of the present invention makes it possible to realize a developer supply container which is excellent in operability.

The lever 32 is provided with the lock portion 32*b* (FIG. 1). Normally, the lock portion 32*b* remains engaged with the lever lock engaging portion 31*c* of the developer supply container 31, preventing thereby the lever 32 from being moved except for the purpose of mounting the developer supply container 31 into the image forming apparatus main assembly 100. As a user inserts the developer supply container 31 into the image forming apparatus main assembly 100, the lever lock engaging portion 31*c* of the developer supply container 31 is disengaged by the lever lock engaging portion disengaging portion (unshown) with which the image forming apparatus main assembly 100 is provided, allowing thereby the lever 32 to be operated.

In this embodiment, the lever 32 is made up of a pair of subordinate levers, which are disposed on the opposing sides of the developer supply container 31, and a connecting portion which connects the pair of subordinate levers. It is rotatably supported with a pair of axes so that it can be rotationally moved relative to the developer supply container 31. Thus, when a user removes or mounts the developer supply container 31, the user is to rotate the lever 32 to generate the force for opening or closing the shutter 33. Incidentally, regarding the movement of the lever 32, the lever 32 may be in the form of a slide lever: The developer supply container 31 is provided with a lever guide (unshown), as is the developer supply container in the first modified version of this embodiment shown in FIG. 12, in order to enable the lever 32 to be slid in a straight line, in the horizontal direction (indicated by arrow mark A in FIG. 12), or in the vertical direction.

Figure 13:
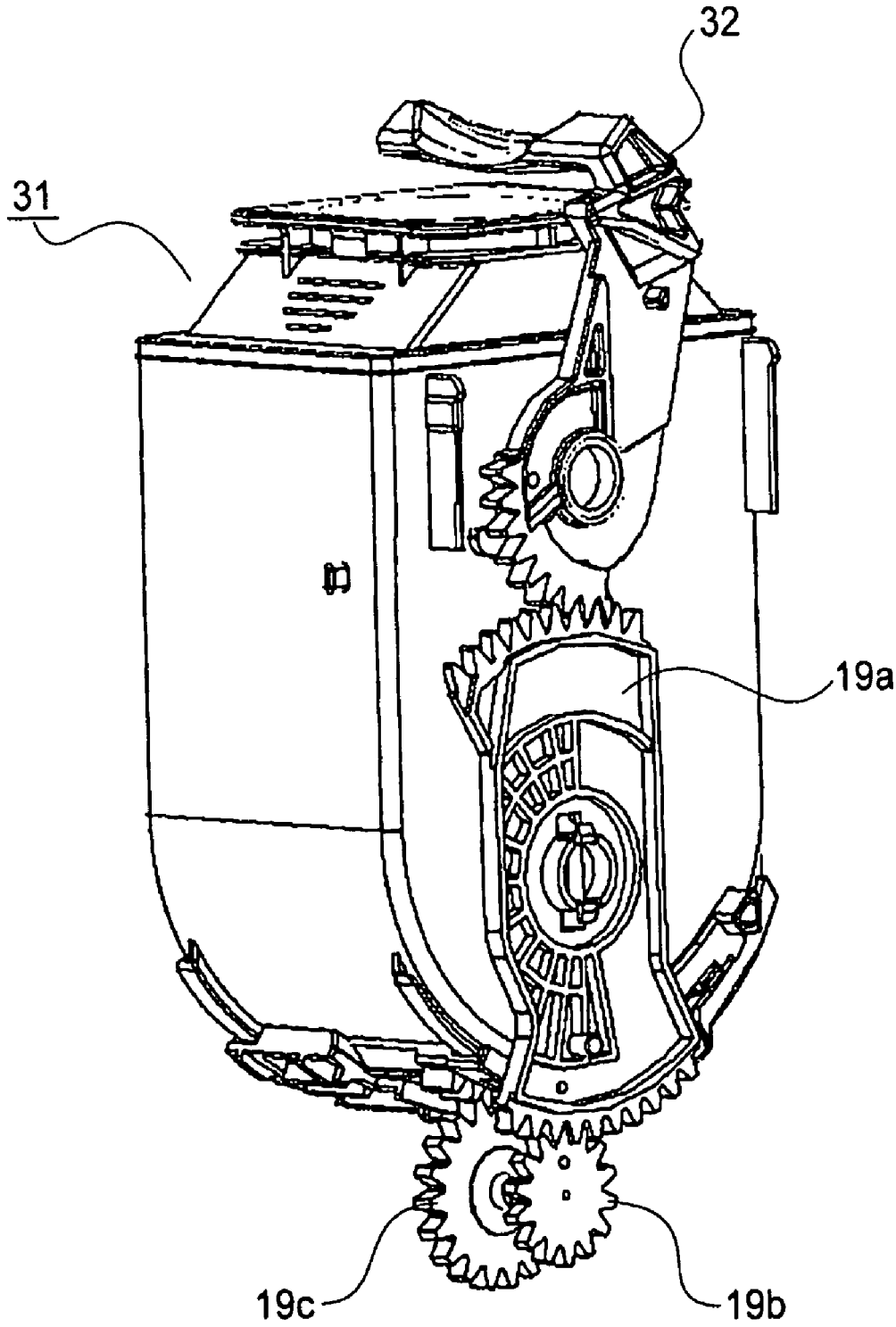
FIG. 13 is an external view of the second modified version of the developer supply container in the preferred embodiment.

Also in this embodiment, the axes with which the lever 32 is rotationally attached to the developer supply container 31 are located on the opposing surfaces of the developer supply container 31 one for one. However, this arrangement is simply for preventing the lever 32 from being deformed, and/or being tilted relative to the developer supply container 3, by the reactive force generated as the force for opening or closing the shutter 33 is transmitted, and is not intended to limit the scope of the present invention. That is, the lever 32 may be constructed like the lever in the second modified version shown in FIG. 13, in which the lever is rotationally attached to the developer supply container 31, or guided, only on one side of the developer supply container 31, as long as the lever is formed of a hard and strong material so that it does not deform, or the portion of the lever, by which the lever is to be axially supported, as well as the lever guide, are structured to be strong.

The above are the descriptions of the mechanism for driving the stirring member 37, and the mechanism, inclusive of the lever 32, for opening or closing the shutter 33. In this embodiment, the above described two driving mechanisms are disposed on the opposing sides of the developer supply container 31, one for one. This arrangement is employed for the following reasons, which will be self explanatory from FIGS. 6-10. That is, the attempt to position the stirring member driving mechanism and shutter driving mechanism (inclusive of lever 32) close to each other, requires the two driving force transmitting portions of the developer supply container 31, that is, the stirring member driving force receiving portion 34 and shutter driving force transmitting portion 32*a*, to be positioned close to each other, which is contrary to the effort to render the developer supply container 31 compact, and therefore, is not desirable. Further, this attempt requires the stirring member driving mechanism 20 and shutter driving mechanism of the image forming apparatus main assembly 100 to be placed in parallel in the same plane, making it thereby difficult to dispose them in the space, the dimension of which in terms of the width direction in FIG. 6 is equivalent to the space which a single developer supply container 31 occupies. In other words, it is problematic in that it does not allow the image forming apparatus main assembly 100 to be rendered satisfactorily compact, and also, it reduces latitude in designing the image forming apparatus main assembly 100. This is why the two driving mechanisms are disposed on the opposing sides of the developer supply container 31 as in this embodiment.

Further, if the two driving mechanisms of the developer supply container 31 are positioned close to each other (in particular, in the same plane), the reactive force generated as the driving forces are transmitted acts in the manner of lifting only one side of the developer supply container 31, and/or the drive shafts become misaligned, causing therefore only one side of the developer supply container 31 to be subjected to the force resulting from the misalignment of the drive shafts. This is why it is desired that the two driving mechanisms are disposed on the opposing sides of the developer supply container 31, as in this embodiment, so that the abovementioned reactive force and/or the force resulting from the misalignment of the drive shafts is distributed in a manner to evenly act on the opposing sides of the developer supply container 31. Further, structuring the developer supply container 31 so that the abovementioned forces are evenly dispersed reduces the amount of the load to which the developer supply container securing portions for regulating the position of the developer supply container 31 are subjected, and therefore, it is desirable from the standpoint of component durability.

(Mounting and Removal of Developer Supply Container 31)

Next, referring to FIGS. 10 and 11, the process of mounting the developer supply container 31 in this embodiment of the present invention into the image forming apparatus main assembly 100 will be described in detail.

Figure 10:
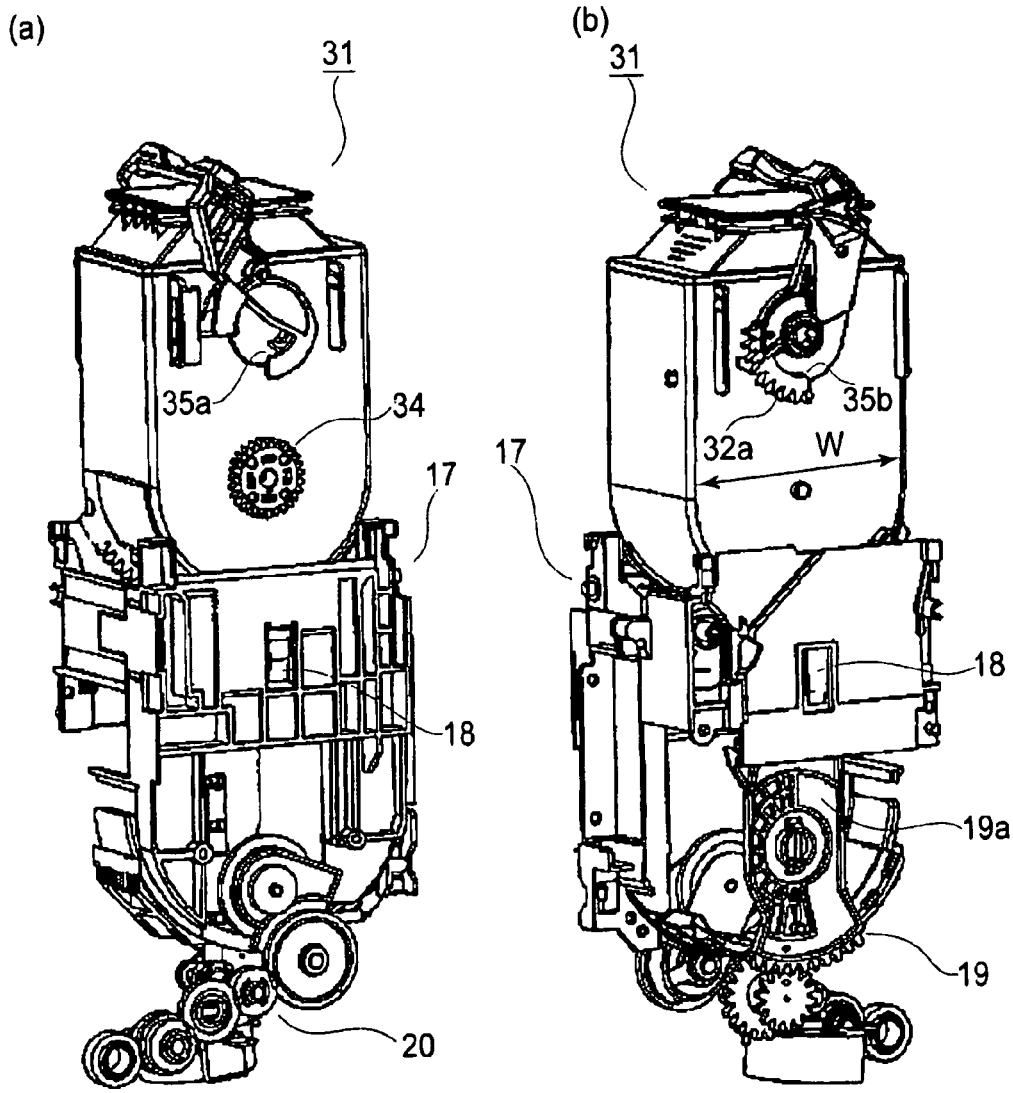
FIGS. 10(*a*) and 10(*b*) are perspective views of the developer supply container and the developer supply container accommodating portion of the main assembly of the image forming apparatus, in which the former is being inserted into the latter.

FIGS. 10(*a*) and 10(*b*) are perspective views of the developer supply container 31 and the developer supply container accommodating portion 17 of the image forming apparatus main assembly 100, in which the former is being mounted into the latter: FIG. 10(*a*) is the perspective view seen from the side from which the stirring member driving force is transmitted, and FIG. 10(*b*) is the perspective view seen from the side from which the shutter driving force is transmitted. FIGS. 11(*a*)-11(*c*) are schematic sectional views of the developer supply container 31 and developer supply container accommodating portion 17: FIG. 11(*a*) showing their states in which the former is being mounted into the latter; FIG. 11(*b*) showing their states in which the developer supply container securing portions 18 of the apparatus main assembly 100 have been bent outward by the developer supply container accommodating portion 17; and FIG. 11(*c*) showing their states in which the insertion of the developer supply container 31 has been completed, and the developer supply container 31 has been locked in place.

Referring to FIGS. 10(*a*) and 10(*b*), a user is to open the top cover 23 (FIG. 5(*b*)) of the image forming apparatus main assembly 100, and insert the developer supply container 31 into the developer supply container accommodating portion 17 from above. As the insertion is completed, the stirring member driving force receiving portion 34 of the developer supply container 31 engages with the gear of the stirring member driving mechanism 20, making it possible for the stirring member driving force to be transmitted to the stirring member 37. Further, the shutter driving force transmitting portion 32*a* of the lever 32 of the developer supply container 31 engages with the idler gear 19*a* of the image forming apparatus main assembly 100, making it possible for the shutter driving force to be transmitted to the shutter 33 through the large gear 19*c* of the stepped gear and the shutter driving force receiving portion 33*a* (FIG. 6).

Figure 11:
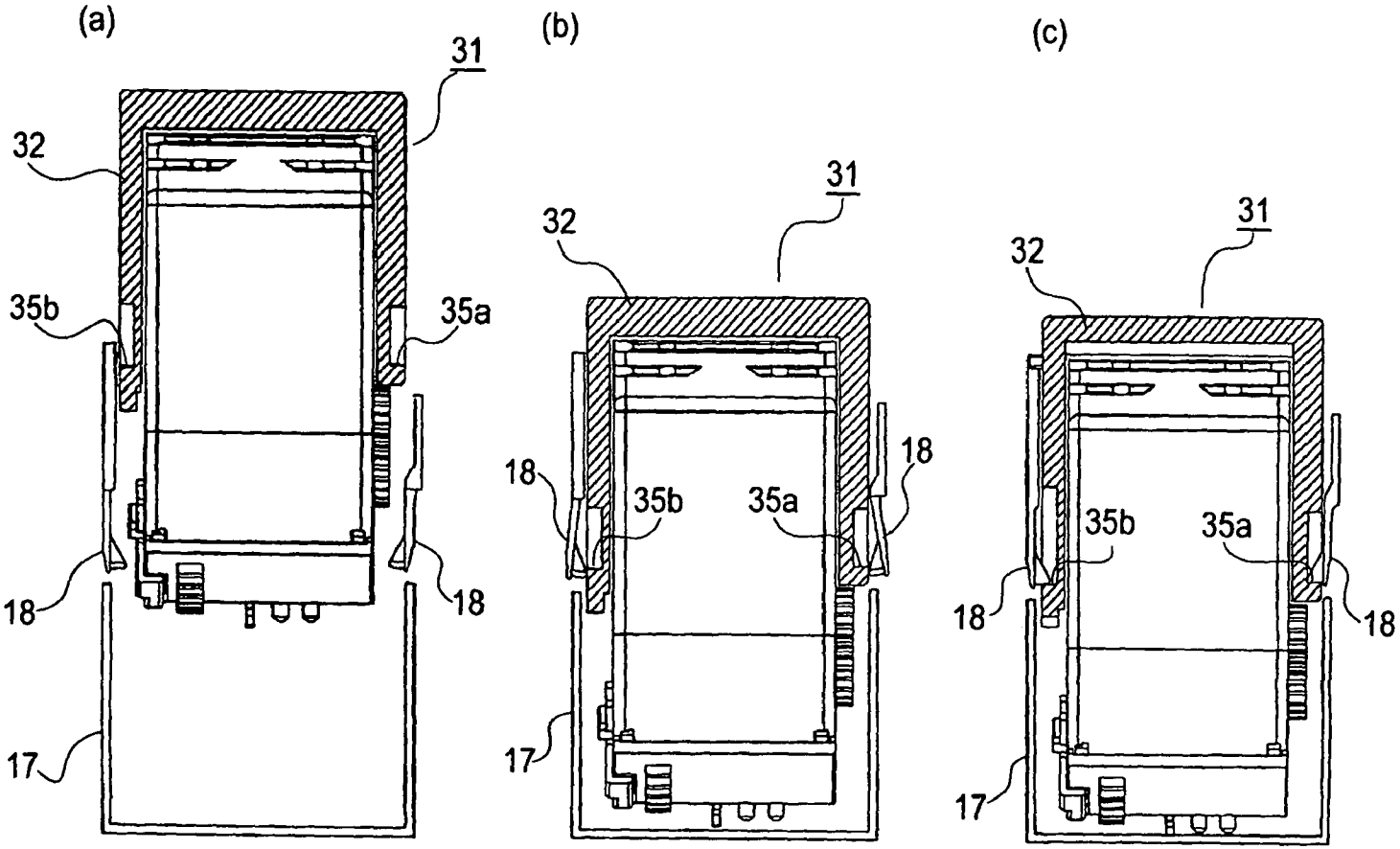
FIGS. 11(*a*), 11(*b*), and 11(*c*) are schematic sectional views of the developer supply container and developer supply container accommodating portion of the main assembly.

Referring to FIG. 11(*a*), the developer supply container 31 is provided with a pair of developer supply container securing portions 35, which are on the opposing sides, one for one, on which the stirring member driving force receiving portion 34 and shutter driving force transmitting portion 32*a* are located, one for one, whereas the developer supply container accommodating portion 17 of the image forming apparatus main assembly 100 is provided with the aforementioned pair of developer supply container securing portions 18, which engage with the developer supply container securing portions 35 of the developer supply container 31 to regulate the movement of the developer supply container 31 in the direction in which the developer supply container 31 is mounted or removed. With the provision of this structural arrangement, the developer supply container 31 is prevented from being accidentally removed, and also, from moving, in particular, in the direction in which the developer supply container 31 is mounted or removed, during the transmission of the above-mentioned various driving forces.

At this time, how the developer supply container securing portions 18 of the apparatus main assembly 100 engage with the developer supply container securing portions 35 of the developer supply container 31 as the developer supply container 31 is inserted into the developer supply container accommodating portion 17 of the image forming apparatus main assembly 100 will be described. Each of the developer supply container securing portions 18 is made up of a leaf spring attached to the developer supply container accommodating portion 17, and a projection attached to the leaf spring. It is rendered elastically deformable in the directions indicated by arrow marks I and J in FIG. 11(*b*). As for the developer supply container securing portions 35 of the developer supply container 31 (the one on the stirring member driving force receiving portion side is designed by referential symbol 35*a*, whereas the one on the shutter driving force transmitting portion side is designated by referential symbol 35*b*), which are structured as a recess, are positioned so that as the developer supply container 31 is inserted into the image forming apparatus main assembly 100, they oppose, one for one, the projections of the developer supply container securing portions 18 on the main assembly side. In this embodiment, they are integral parts of the lever 32.

As a user inserts the developer supply container 31 into the developer supply container accommodating portion 17 from directly above as shown in FIG. 11(*a*), the developer supply container securing portions 35 temporarily bend the developer supply container securing portions 18 outward of the developer supply container accommodating portion 17 (FIG. 11(*b*)). As the developer supply container 31 is further inserted, the developer supply container securing portions 35 of the developer supply container 31 align with the developer supply container securing portions 18 of the apparatus main assembly 100, allowing thereby the developer supply container securing portions 18 to be moved inward of the developer supply container accommodating portion 17 by the resiliency of the developer supply container securing portions 18 so that the two pairs of developer supply container securing portions engage as shown in FIG. 11(*c*). With the engagement of the developer supply container securing portions 35 with the developer supply container securing portions 18, the occurrence of such an operational error as an accidental removal of the developer supply container 31 is prevented, and also, the developer supply container 31 is prevented from being tilted, or moved in the direction in which it is to be removed or mounted, by the aforementioned reactive force generated as the driving forces are transmitted, and the forces generated as the driving shafts become misaligned. Therefore, the driving forces are reliably transmitted. In particular, in the case in which the developer supply container 31 and developer supply container accommodating portion 17 are structured so that as the developer supply container 31 is inserted into the developer supply container accommodating portion 17, the gear of the developer supply container 31 engages with the gear of the image forming apparatus main assembly 100, the reactive force is generated by the two gears in the direction to cause the distance between the axes of the two gears to increase. Therefore, if the developer supply container 31 is not perfectly secured, it is possible that the skipping will occur between the two gears, preventing thereby the driving forces from being satisfactorily transmitted. However, with the provision of the above described structural arrangement, it becomes possible to provide a developer supply container which is highly reliable, that is, which does not suffer from the above described problems, in spite of being simple in structure as described above.

Also in this embodiment, the stirring member driving force receiving portion 34 and shutter driving force transmitting portion 32*a* are located on the opposing sides of the developer supply container 31 as described above. Therefore, the developer supply container securing portion 35*a* and developer supply container securing portion 35*b* of the developer supply container 31 are located on the stirring member driving side and shutter driving side of the developer supply container 31, ensuring that the portions of the developer supply container 31 having the driving portions are prevented from being moved.

Also in this embodiment, the method of inserting the developer supply container 31 into the image forming apparatus main assembly 100 from directly above, as described before, in order to render the image forming apparatus main assembly 100 compact and to reduce the actual space which the image forming apparatus main assembly 100 physically occupies and the space which the image forming apparatus main assembly 100 requires for its operation. Therefore, the developer supply container 31 and the driving force transmitting mechanisms of the image forming apparatus main assembly 100 are structured, as the most desirable example, so that as the gears of the developer supply container 31 mesh with the corresponding gears of the driving force transmitting portions of the image forming apparatus main assembly 100, the reactive forces resulting from the meshing of the gears act in the direction to decrease the distance between the axes of the gears on the developer supply container side and the axes of the gears on the apparatus main assembly side. However, the structural arrangement for engaging the driving portions on the developer supply container side with the driving portion on the main assembly side does not need to be limited to the above described meshing of the two gears. For example, a coupler retraction system may be employed: The stirring member driving force receiving portion 34 of the developer supply container 31 is provided with a projection so that when the developer supply container 31 is inserted, the stirring member driving mechanism 20 of the image forming apparatus main assembly 100 is retracted outward, and as soon as the insertion of the developer supply container 31 is completed, the stirring member driving mechanism 20 is moved inward to be engaged with the stirring member driving force receiving portion 34 to make it possible for the driving force to be transmitted. However, the employment of this coupler retraction system requires an additional space, that is, the space into which the stirring member driving mechanism 20 of the image forming apparatus main assembly 100 is to be retracted, which is contrary to the intent of making the image forming apparatus main assembly 100 compact. Therefore, from the standpoint of spatial efficiency, it is preferable to employ the gear-to-gear engagement system, such as the one employed in this embodiment, in which the gear engagement occurs as the gears are moved in the direction to reduce the distance between the rotational axes of the two gears.

Figure 14:
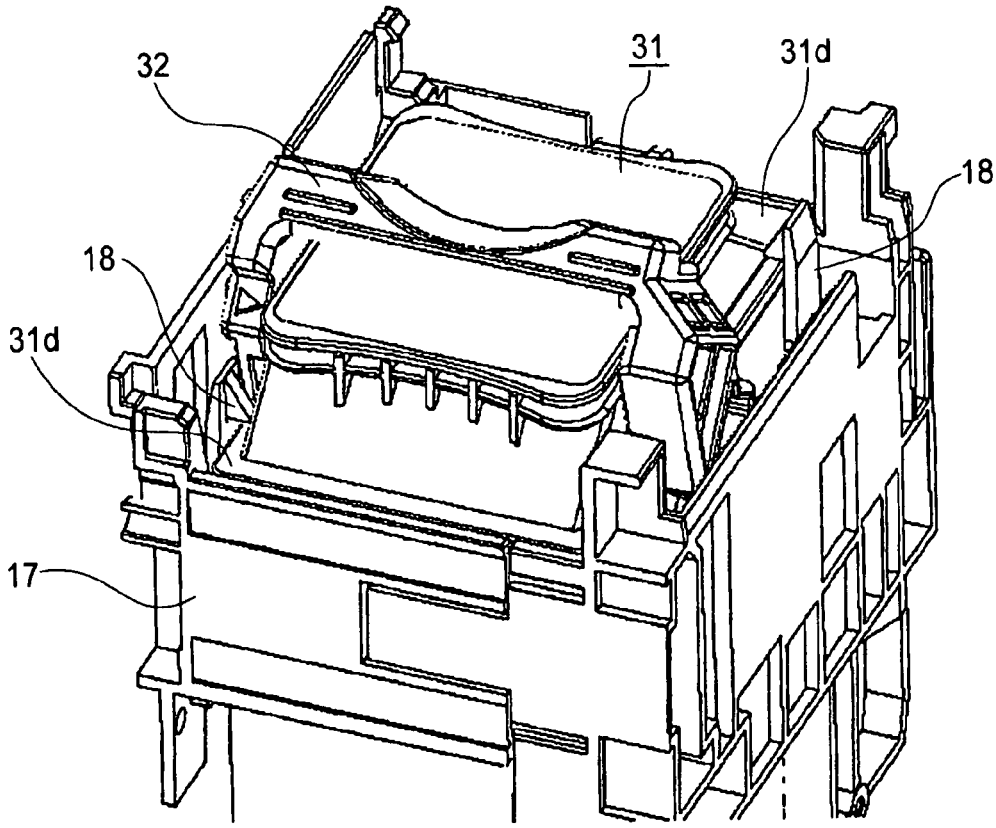
FIG. 14 is an external view of the third modified version of the developer supply container in the preferred embodiment.

Also in this embodiment, the developer supply container securing portions 35 are formed as parts of the lever 32. However, the positioning of the developer supply container securing portions 35 does not need to be limited to that in this embodiment. For example, the developer supply container securing portions 35 may be positioned like those in the third modified version of this embodiment shown in FIG. 14: the structural arrangement is such that the shoulder portions 31*d* of the developer supply container 31 are engaged with the developer supply container securing portions 18 on the main assembly side. In addition to the setup shown in FIG. 14, the structural arrangement may be such that one of the two developer supply container securing portions 35 is formed as a part of the container proper of the developer supply container 31, whereas the other developer supply container securing portion 35 is formed as a part of the lever 32. In other words, the positioning of the developer supply container securing portions 35 is optional. However, the lever 32 is provided with the shutter driving force transmitting portion 32*a*. Therefore, from the standpoint of ensuring that the distance between the axes of the above described two gears does not change, it is desired that the developer supply container securing portions 35 of the developer supply container 31 are formed as parts of the lever 32 which directly catches the reactive forces from the gears.

Further, positioning the developer supply container securing portions (developer supply container securing portions 18 on main assembly side as well as developer supply container securing portions 35 on developer supply container side) on the upstream side of the stirring member driving force receiving portion 34 and shutter driving force transmitting portion 32*a* of the developer supply container 31, in terms of the developer supply container insertion direction, prevents the developer supply container securing portions 18 and 35 from interfering with the driving systems of the image forming apparatus main assembly 100, and therefore, is preferable. Moreover, by positioning the developer supply container securing portions so that when mounting the developer supply container 31 into the image forming apparatus main assembly 100, they will be on the upstream side of the driving mechanism portion in terms of the developer supply container insertion direction, the driving mechanism portions will be the inward side of the developer supply container accommodating portion, in terms of the developer supply container insertion direction, when mounting the developer supply container 31. Therefore, a user is prevented from accidentally touching the driving mechanism portion. Therefore, it is possible to provide a developer supply container which contributes to providing an image forming apparatus which is high in operational safety. On the other hand, positioning the developer supply container securing portions so that when mounting the developer supply container 31 into the image forming apparatus main assembly 100, they will be on the upstream side of the driving mechanism portions in terms of the developer supply container insertion direction, places the developer supply container securing portions on the upstream side of the developer supply container accommodating portion in terms of the developer supply container insertion direction, making it thereby easier to disengage the developer supply container securing portions when removing or mounting the developer supply container 31, and also, making it possible to simplify the developer supply container securing portions. Therefore, it is possible to provide an image forming apparatus main assembly which is compact and inexpensive. Incidentally, an image forming apparatus may be provided with a developer supply container securing portion disengaging mechanism, or the like, which is independent from the developer supply container securing portions, and disengages the developer supply container securing portions with the use of one of the known methods when removing the developer supply container 31. For example, an image forming apparatus in accordance with the present invention may be structured so that as the lever 32 is moved when mounting or removing the developer supply container 31, the developer supply container securing portions are disengaged by the movement of the lever 32.

Further, in the case in which the developer supply container securing portions 35 on the developer supply container side are formed as parts of the lever 32, a structural arrangement may be made so that the distance between the axes of the aforementioned two gears becomes smallest when the lever 32 reaches the point at which the shutter 33 is opened widest (at the end of mounting of developer supply container 31). With the provision of this structural arrangement, it is possible to make highest the sealing performance of a sealing member 39, with which the developer outlet 38 is provided, when the developer outlet 38 is opened widest, while keeping the sealing performance modest during the movement of the shutter 33 in order to reduce the amount of force necessary to move the shutter 33. In other words, the employment of this structural arrangement makes it possible to reduce the amount of the force which a user must exert to operate the lever 32, which is desirable.

As described above, regarding a developer supply container designed to be inserted into the image forming apparatus main assembly from such a direction that as it is inserted, it will be subjected to the reactive force from the driving mechanism portion of the image forming apparatus main assembly, the stirring member driving force receiving portion and shutter driving force transmitting portion of the developer supply container are positioned on the opposing two sides of the developer supply container, and further, the pair of developer supply container securing portions of the developer supply container for preventing the developer supply container from shifting relative to the image forming apparatus main assembly after the mounting of the developer supply container into the image forming apparatus main assembly are also positioned on the opposing two sides of the developer supply container. Therefore, it is not required to position two driving force transmitting portions on the same side, making it thereby possible to divide the space necessary for the driving portions of the developer supply container. Therefore, it is possible to provide a developer supply container which is substantially more compact than a developer supply container in accordance with any of the prior arts. As for the image forming apparatus main assembly, its driving mechanisms can also be positioned on the opposing two internal surfaces of the developer supply container accommodating portion, making it possible to prevent the driving mechanisms from interfering with each other. In other words, the employment of the above described structural arrangement reduces the restrictions placed on the positioning of the driving mechanisms, that is, affording more latitude in the design of the image forming apparatus main assembly, and therefore, making it possible to reduce the space which the main assembly occupies as well as the space it requires for operation.

Further, positioning the two driving portions on the opposing two sides of the developer supply container makes it possible to cause the reactive forces from the driving portions to evenly apply to the developer supply container. In other words, the force that applies to the developer supply container securing portions of the developer supply container for regulating the position of the developer supply container is evenly dispersed, making it unnecessary to overly reinforce the developer supply container securing portions.

Further, the position of the developer supply container in terms of the developer supply container insertion direction can be easily and reliably regulated. Therefore, more latitude is afforded in terms of the direction from which the developer supply container is to be mounted into the image forming apparatus main assembly. For example, it is possible to design the image forming apparatus main assembly so that the developer supply container can be mounted from above, and therefore, the image forming apparatus main assembly can be reduced in its foot print inclusive of the space necessary for its operation.

Further, the driving force transmitting portions are made up of gears, eliminating therefore the need for a complicated mechanism. Therefore, it is possible to provide a developer supply container which is low in cost, and yet, high in the level of reliability at which the driving forces are transmitted.

Further, the developer supply container securing portions of the developer supply container are positioned one for one on the opposing two sides of the developer supply container, on which the stirring member driving force receiving member and shutter driving force receiving portion of the developer supply container are positioned one for one. Therefore, even in the case in which the method of inserting the developer supply container into the image forming apparatus main assembly from such a direction that as the developer supply container is inserted into the image forming apparatus main assembly, it is subjected to the reactive forces from the driving portions, the driving portions of the developer supply container will reliably align with those of the image forming apparatus main assembly, ensuring that the driving forces are reliably transmitted. In particular, by employing gears to transmit the driving forces as in this embodiment, it is assured that the distance between the axes of the driving force transmission gears is not increased by the reactive forces, and therefore, it is ensured that the unsatisfactory transmission of the driving forces, which is attributable to the skipping or the like of the gears, which is attributable to the increase in the abovementioned distance, is prevented.

Further, such a structural arrangement is made that the gears on the developer supply container side mesh with the corresponding gears on the image forming apparatus main assembly side as the developer supply container is moved in the direction to reduce the distance between the axes of the two gears. Therefore, even in the case that the method for mounting the developer supply container into the image forming apparatus main assembly from such a direction that as the developer supply container is mounted into the image forming apparatus main assembly, it is subjected to the reactive forces from the driving portions, it is possible to provide a developer supplying method, which is not inferior in spatial efficiency, is simple, and is no higher in cost than a developer supply container in any of the prior arts. Therefore, it is possible to provide a developer supply container which allows the image forming apparatus main assembly to be reduced in its foot print inclusive of the space necessary for its operation.

Further, the abovementioned structural arrangement makes it possible for the developer supply container to be mounted into the image forming apparatus main assembly from above, improving thereby the image forming apparatus main assembly in terms of the visibility of the developer supply container during the replacement of the developer supply container, and allowing a user to replace the developer supply container while standing upright. In other words, the abovementioned structural arrangement makes it possible to provide a developer supply container which is superior in terms of the developer supply container mounting method, from the standpoint of the posture which a user must to assume when mounting the developer supply container.

Further, the shutter driving force transmitting portion is formed as a part of the lever. Therefore, it becomes possible to provide a developer supply container which is superior in operability while being mounted or removed, smaller in component count, simpler in structure, and lower in cost than a developer supply container in accordance with any of the prior arts.

Further, the lever is supported with the use of a pair axes, on the opposing two sides of the developer supply container. Therefore, the lever is prevented from being deformed, and/or tilted, by the moment which occurs as a user transmits the force for opening or closing the shutter by operating the lever. In other words, the lever is reliably operable. Therefore, it becomes possible to provide an inexpensive developer supply container which is superior in operability.

Further, the developer supply container securing portions are provided as parts of the lever having the shutter driving force transmitting portion. Therefore, it is possible to reliably regulate in position, without cost increase, the components which are directly subjected to such forces as the reactive forces from the gears, making it thereby possible to maintain a proper amount of inter-axial distance among the aforementioned gears. Therefore, it becomes possible to provide a developer supply container which is highly reliable in terms of the transmission of the driving forces.

Further, the developer supply container securing portions on the developer supply container side are positioned so that when the developer supply container is mounted into the image forming apparatus main assembly, it will be placed on the upstream side of the stirring member driving force receiving portion and shutter driving force transmitting portion of the developer supply container. Therefore, the developer supply container securing portions on the image forming apparatus main assembly side can be positioned so that they do not infringe into the space in which the driving mechanisms on the image forming apparatus main assembly side are disposed, contributing thereby to improving the image forming apparatus main assembly in spatial efficiency. Further, the developer supply container securing portions on the developer supply container side are positioned on the upstream side of the driving mechanism of the developer supply container in terms of the developer supply container mounting direction. Therefore, the driving mechanism portion of the image forming apparatus main assembly is positioned on the downstream side of the developer supply container accommodating portion of the image forming apparatus main assembly in terms of the developer supply container mounting direction. Therefore, a user is prevented from accidentally touching the driving mechanism portion of the image forming apparatus main assembly, rendering thereby the image forming apparatus main assembly higher in operational safety.

As will be evident from the above descriptions of the preferred embodiment of the present invention, the present invention makes it possible to provide a highly reliable developer supply container having a driving force transmission mechanism which is no higher in cost, simpler in structure, smaller in the space it occupies, better in operability, and more reliable than a driving force transmission mechanism in accordance with any of the prior arts, and an image forming apparatus which employs such a developer supply container.

[Possible Industrial Usage]

The present invention relates to a developer supply container for supplying developer in the form of particulate to an electrophotographic image forming apparatus (which hereinafter will be referred to simply as image forming apparatus) which forms an image with the use of the developer, and an image forming apparatus which employs such a developer supply container.

INDUSTRIAL APPLICABILITY

As described hereinabove, according to the present invention, it is possible to provide a developer supply container which is mounted in the main assembly of an image forming apparatus from such a direction that as the developer supply container is mounted into the main assembly, it is subjected to the reactive forces from the developer supply container driving portions, and yet, is simple and compact in structure, and reliable in operation, and an image forming apparatus which employs such a developer supply container.

While the invention has been described with reference to the structures disclosed herein, it is not confined to the details set forth, and this application is intended to cover such modifications or changes as may come within the purposes of the improvements or the scope of the following claims.

The invention claimed is:

1. A developer supply container for supplying developer to a developer receiving portion of a main assembly of an electrophotographic image forming apparatus, said developer supply container being mountable to a main assembly of the image forming apparatus, said developer supply container comprising:

a developer accommodating portion that accommodates a developer;

a discharge opening that permits the discharge of the developer;

a stirring member that stirs the developer in said developer accommodating portion;

a stirring drive receiving portion, provided in one of opposing sides of said developer supply container, that receives a stirring driving force for driving said stirring member from a stirring drive transmitting portion provided in the main assembly of the image forming apparatus and that transmits the stirring driving force to said stirring member;

an openable member movable to open and close said discharge opening;

an opening and closing drive receiving portion, provided in said openable member, that receives an opening and closing driving force for moving said openable member;

an opening and closing drive transmitting portion, provided in the other of the opposing sides, that transmits the opening and closing driving force to said opening and closing drive receiving portion through an opening and closing driving relay portion provided in the main assembly of the image forming apparatus;

wherein by mounting said developer supply container to the main assembly of the image forming apparatus, drive force transmittable engagements are established between the stirring drive transmitting portion and said stirring drive receiving portion, between said opening and closing drive transmitting portion and the opening and closing driving relay portion, and between the opening and closing driving relay portion and said opening and closing drive receiving portion, respectively, so that the stirring driving force is transmittable from the stirring drive transmitting portion to said stirring drive receiving portion, and the opening and closing driving force is transmittable from said opening and closing drive transmitting portion to said opening and closing drive receiving portion, and wherein a mounting direction in which said developer supply container is mounted to the main assembly of the image forming apparatus opposes the direction of a force received by said developer supply container from the main assembly of the image forming apparatus; and an engaging portion, provided adjacent each of said opposing sides, that limits movement of said developer supply container in a dismounting direction in which said developer supply container is dismounted from the main assembly of the image forming apparatus by engagement with a locking portion provided in the main assembly of the image forming apparatus when said developer supply container is mounted to the main assembly of the image forming apparatus.

2. An apparatus according to claim 1, wherein said stirring drive receiving portion, said opening and closing drive receiving portion and said opening and closing drive transmitting portion include gears, respectively.

3. An apparatus according to claim 2, wherein the mounting direction is such that rotational centers of the gears of said stirring drive receiving portion and said opening and closing drive transmitting portion approach the rotational centers of gears of the stirring drive transmitting portion and the opening and closing driving relay portion, respectively.

4. An apparatus according to claim 1, further comprising a lever member movably provided on said developer supply container, wherein said opening and closing drive transmitting portion is provided on said lever member, and wherein said lever member is manually operable to open and close said openable member when said developer supply container is mounted to the main assembly of the image forming apparatus.

5. An apparatus according to claim 4, wherein said lever member is rotatably supported on said opposing sides.

6. An apparatus according to claim 5, wherein said engaging portion is provided on said lever member.

7. An apparatus according to claim 1, wherein in a state in which said developer supply container is mounted to the main assembly of the image forming apparatus, said stirring drive receiving portion and said opening and closing drive transmitting portion are disposed downstream of a position where said engaging portion and the locking portion are engaged with each other with respect to the mounting direction.

8. An image forming apparatus comprising:

an image forming station that forms an image with a developer;

a mounting portion that mounts a developer supply container accommodating a developer to be supplied to said image forming station;

a developer receiving portion that receives the developer supplied through a discharge opening of the said developer supply container;

a stirring drive transmitting portion that transmits a stirring driving force for driving a stirring member provided in the developer supply container to a stirring drive receiving portion provided in one of opposing sides of said the developer supply container;

an opening and closing drive transmitting portion that transmits an opening and closing driving force for moving an openable member provided in the developer supply container to open and close the discharge opening, the opening and closing drive transmitting portion being provided in the other one of the opposing sides;

an opening and closing driving relay portion that receives the opening and closing driving force from said opening and closing drive transmitting portion and transmits the opening and closing driving force to an opening and closing drive receiving portion provided in the openable member, wherein by mounting the developer supply container to the main assembly of said image forming apparatus, drive force transmittable engagements are established between said stirring drive transmitting portion and the said stirring drive receiving portion, between said opening and closing drive transmitting portion and said opening and closing driving relay portion, and between said opening and closing driving relay portion and the opening and closing drive receiving portion, respectively, so that the stirring driving force is transmittable from said stirring drive transmitting portion to the stirring drive receiving portion, and the opening and closing driving force is transmittable from said opening and closing drive transmitting portion to said opening and closing drive receiving portion, and wherein a mounting direction in which the developer supply container is mounted to the main assembly of said image forming apparatus is opposed to the direction of a force received by the developer supply container from the main assembly of said image forming apparatus; and a locking portion, provided adjacent each of portions which are opposed by the opposing sides when the developer supply container is mounted to said apparatus, that limits movement of the developer supply container in a dismounting direction in which the developer supply container is dismounted from the apparatus by engagement with an engaging portion of the developer supply container.

9. An apparatus according to claim 8, wherein said stirring drive transmitting portion, and said opening and closing driving relay portion include gears, respectively.

10. An apparatus according to claim 9, wherein the mounting direction is such that rotational centers of gears of said stirring drive receiving portion and said opening and closing drive transmitting portion approach the rotational centers of the gears of said stirring drive transmitting portion and said opening and closing driving relay portion, respectively.

11. An apparatus according to claim 8, wherein a lever member is movably provided on the developer supply container, wherein said opening and closing drive transmitting portion is provided on said lever member, wherein said lever member is manually operable to open and close the openable member when the developer supply container is mounted to said main assembly of said image forming apparatus.

12. An apparatus according to claim 11, wherein said lever member is rotatably supported on said opposing sides.

13. An apparatus according to claim 12, wherein the engaging portion is provided on said lever member.

14. An apparatus according to claim 8, wherein in a state in which the developer supply container is mounted to said mounting portion, said stirring drive receiving portion and said opening and closing drive transmitting portion are disposed downstream of a position where the engaging portion and said locking portion are engaged with each other with respect to the mounting direction.

* * * * *